US009530577B2

(12) United States Patent
Wan

(10) Patent No.: US 9,530,577 B2
(45) Date of Patent: Dec. 27, 2016

(54) CIRCUIT BREAKER

(71) Applicants: Hubei Shengjia Wiring Co., Ltd., Wuhan (CN); Jiasheng Wan, Wuhan (CN)

(72) Inventor: Jiasheng Wan, Wuhan (CN)

(73) Assignees: HUBEI SHENGJIA WIRING CO., LTD., Wuhan (CN); Jiasheng Wan, Wuhan (CN)

( * ) Notice: Subject to any disclaimer, the term of this patent is extended or adjusted under 35 U.S.C. 154(b) by 0 days.

(21) Appl. No.: 14/735,107

(22) Filed: Jun. 9, 2015

(65) Prior Publication Data

US 2015/0279581 A1 Oct. 1, 2015

Related U.S. Application Data

(63) Continuation of application No. 13/433,515, filed on Mar. 29, 2012, now Pat. No. 9,064,666, which is a continuation-in-part of application No. PCT/CN2010/000831, filed on Jun. 11, 2010.

(30) Foreign Application Priority Data

Sep. 29, 2009 (CN) ..... 2009 1 0179558
Sep. 29, 2009 (CN) ..... 2009 1 0179587

(51) Int. Cl.

| | |
|---|---|
| ***H01H 3/40*** | (2006.01) |
| ***H01H 3/26*** | (2006.01) |
| ***H01H 71/10*** | (2006.01) |
| ***H01H 77/06*** | (2006.01) |

(52) U.S. Cl.
CPC ..... *H01H 3/26* (2013.01); *H01H 71/10* (2013.01); *H01H 77/06* (2013.01); *H01H 2003/266* (2013.01)

(58) Field of Classification Search
CPC ..... H01H 71/10; H01H 71/52; H01H 71/70; H01H 83/00
USPC ..... 200/501
See application file for complete search history.

(56) References Cited

U.S. PATENT DOCUMENTS

| | | | | |
|---|---|---|---|---|
| 4,990,873 A * | 2/1991 | Grunert | ..... | H01H 71/70 335/14 |
| 6,388,858 B1 * | 5/2002 | Simms | ..... | H01H 89/06 335/14 |
| 6,522,227 B1 * | 2/2003 | Mody | ..... | H01H 71/70 335/14 |

(Continued)

*Primary Examiner* — Kyung Lee
(74) *Attorney, Agent, or Firm* — Matthias Scholl, PC; Matthias Scholl

(57) ABSTRACT

A circuit breaker, including a circuit breaker body, a handle, a bottom box, and a bearing plate. The circuit breaker body includes an upper cover, and a notch groove is formed on the upper cover. Two ends of the notch groove are positioned in the on/off position corresponding to the circuit breaker. The handle extends out of the notch groove. A circuit breaker actuating mechanism, a wire inlet end, and a wire outlet end are arranged on the bottom box. The circuit breaker actuating mechanism is triggered by the handle. The bearing plate is arranged between the upper cover and the bottom box and combined with an electrical operating mechanism. The handle is switched in the on/off state during the operation of the electrical operating mechanism under the control of an automatic closing control unit.

5 Claims, 20 Drawing Sheets

(56) References Cited

U.S. PATENT DOCUMENTS

| | | | | |
|---|---|---|---|---|
| 6,963,042 | B1 * | 11/2005 | Kouris | H01H 71/70 200/331 |
| 7,280,013 | B2 * | 10/2007 | Lewis | H01H 71/70 335/17 |
| 2004/0149555 | A1 * | 8/2004 | Jordan | H01H 71/1009 200/400 |

* cited by examiner

CIRCUIT BREAKER

CROSS-REFERENCE TO RELATED APPLICATIONS

This application is a continuation of U.S. application Ser. No. 13/433,515, filed on Mar. 29, 2012, now pending, which is a continuation-in-part of International Patent Application No. PCT/CN2010/000831 with an international filing date of Jun. 11, 2010, designating the United States, now pending, and further claims priority benefits to Chinese Patent Application No. 200910179587.6 filed Sep. 29, 2009, and to Chinese Patent Application No. 200910179558.X filed Sep. 29, 2009. The contents of all of the aforementioned applications, including any intervening amendments thereto, are incorporated herein by reference. Inquiries from the public to applicants concerning this document or the related applications should be directed to: Matthias Scholl P. C., Attn.: Dr. Matthias Scholl Esq., 245 First Street, 18$^{th}$ Floor, Cambridge, Mass. 02142.

BACKGROUND OF THE INVENTION

Field of the Invention

The invention relates to a circuit breaker, and more particularly to a built-in circuit breaker capable of realizing automatic closing function, and an intelligent circuit breaker with an automatic closing control unit.

Description of the Related Art

As to the electric power department, a circuit breaker is an essential device for ensuring the electricity safety and circuit switching. With the launch of state to the smart grid plan, developing towards the intelligent circuit breaker is a very important direction.

As shown in FIG. 1, an example of a circuit breaker in the prior art, which is called a circuit breaker body in the invention. The circuit breaker can be a three-phase or a single-phase circuit breaker, and can also be an ordinary miniature circuit breaker or a big switch. Each circuit breaker includes a box body; the box body includes an upper cover and a bottom box, wherein a notch groove is formed on the upper cover, and two ends of the notch groove are positioned in the on/off position correspondingly to the circuit breaker; a handle extends out of the notch groove; a circuit breaker actuating mechanism, a wire inlet end and a wire outlet end are arranged on the bottom box, and the circuit breaker actuating mechanism is triggered through the handle; the circuit breaker actuating mechanism further includes a linkage component connected with the handle, a movable contact arm is hinged at the lower end of a linkage rod of the linkage component, when the linkage component rotates under the action of the handle, the movable contact arm is driven to rotate, a moving contact on the movable contact arm is in contact with a stationary contact on a static contact piece, and the static contact piece is connected with the wire outlet end on the bottom box, so that the purpose of transmitting current out is achieved.

However, the conventional circuit breaker still has the following defects:

1. In a prepayment system, the circuit breaker cannot be automatically closed after the electricity bills are paid by electricity consumers, and the electricity consumers have to deal with it by themselves, thus inconvenience is brought to the electricity consumers;
2. When the temperature is too high, and the use of electricity is abnormal, the opening speed of the conventional circuit breaker is slower; and 3. The circuit breaker can be closed by users under the condition without eliminating the condition of abnormal use of electricity, thus potential safety hazards may be caused.

In view of the above defects, the creator of the invention finally invents the circuit breaker after long time of research and practice.

SUMMARY OF THE INVENTION

In view of the above-described problems, it is one objective of the invention to provide a built-in circuit breaker with automatic closing function.

To achieve the above objective, in accordance with one embodiment of the invention, there is provided a built-in circuit breaker with automatic closing function, comprising: a circuit breaker body, the circuit breaker body comprising an upper cover and a bottom box, wherein a notch groove is formed on the upper cover, and two ends of the notch groove are positioned in the on/off position correspondingly to the circuit breaker; a handle extends out of the notch groove; a circuit breaker actuating mechanism, a wire inlet end, and a wire outlet end are arranged on the bottom box, and the circuit breaker actuating mechanism is triggered through the handle; a bearing plate is arranged between the upper cover and the bottom box and combined with an electrical operating mechanism, the electrical operating mechanism is provided with an execution end connected with the handle, and the handle is switched in the on/off state during the operation of the electrical operating mechanism under the control of an automatic closing control unit.

Based on different working principles, the electrical operating mechanism can be classified into three categories. One is that, the electrical operating mechanism comprises a pinion-and-rack mechanism and a shifting part; the shifting part is connected with the handle; a motor is arranged in a bottom box, and the pinion-and-rack mechanism transforms the rotation of the motor into reciprocating action of the shifting part, so that the circuit breaker actuating mechanism is triggered by the handle to realize the on/off of the circuit breaker.

Optionally, the electrical operating mechanism comprises: a translational mechanism and a shifting part; the shifting part is connected with the handle; the translational mechanism drives the shifting part to make reciprocating motion, so that the circuit breaker actuating mechanism is triggered by the handle to realize the on/off of the circuit breaker.

Further optionally, the electrical operating mechanism comprises a crank part and a shifting part, and the shifting part is connected with the handle; a motor is arranged in the bottom box, and the rotation of the motor is transformed into reciprocating action of the shifting part through the crank part under the control of the automatic closing control unit, so that the handle is switched in the on/off state.

The automatic closing control unit comprises:

- a power collection subunit acquiring a power signal from a phase line and conducting rectifying and filtering; and
- a motor motion control subunit obtaining the power signal, allowing the motor to move when receiving the closing command, and ultimately realizing the closing action of the circuit breaker actuating mechanism.

To have protection function at short circuit or abnormal electricity conditions, the automatic closing control unit further comprises:

a short-circuit detection circuit used for detecting whether a short circuit occurs as well as generating a tripping control signal when a short circuit occurs; and a tripping subunit used for allowing the circuit breaker actuating mechanism to generate switch-off action after receiving the tripping control signal.

To prevent the circuit breaker from switching on automatically under the condition without eliminating the abnormal conditions, the automatic closing control unit further comprises: a self-locking control subunit; the self-locking control subunit is connected with the motor motion control subunit and receives a self-locking control signal (indicating the short-circuit conditions) output by the short-circuit detection subunit, so that the motor motion control subunit enables the motor does not to generate action.

To achieve the remote control, for example, for prepayment, the automatic closing control unit further comprises an external control unit; the external control unit is connected with the tripping subunit and the motor motion control subunit respectively and receives an external control signal, so as to control the tripping device and the motor.

The short-circuit detection circuit comprises at least a short-circuit detection element arranged for at least one phase line and connected with a decision element, and the decision element generates the self-locking control signal and the tripping control signal according to the state of the short-circuit detection element in the case of short circuit.

The automatic closing control unit further comprises a temperature detection subunit for detecting the temperature of the phase line and generates a self-locking control signal and/or tripping control signal when the temperature reaches the threshold value.

The temperature detection subunit comprises a temperature detection element arranged for at least one phase line and connected with the decision element, and the decision element generates the self-locking control signal and/or tripping control signal according to the state of the temperature detection element at the abnormal temperature.

The automatic closing control unit further comprises a limit subunit which sends out a control signal to the motor motion control subunit after the circuit breaker is closed, so as to enable the motor to stop.

The limit subunit comprises a photoelectric coupler, and after the circuit breaker is closed, a stage change is generated at the output terminal and transmitted to the motor motion control subunit to enable the motor to stop.

In accordance with another embodiment of the invention, there provided is an intelligent circuit breaker with automatic closing function, comprising: a box body and a circuit board, wherein the box body comprises an upper cover and a bottom box, and a circuit breaker actuating mechanism for switching on/off the circuit breaker, a wire inlet end, and a wire outlet end are arranged in the box body; the circuit board comprises an automatic closing control unit; the operation of a motor is realized through the automatic closing control unit, and the circuit breaker actuating mechanism is driven to move through an electrical operating mechanism; the automatic closing control unit comprises:

a power collection subunit acquiring a power signal from a phase line and conducting rectifying and filtering; and a motor motion control subunit obtaining the power signal, allowing the motor to move when receiving the closing command, and ultimately realizing the closing action of the circuit breaker actuating mechanism.

The circuit breaker actuating mechanism comprises: a poke rod extending out of the box body (similar to a handle) or a linkage rod arranged in the circuit breaker actuating mechanism.

Based on different working principles, the electrical operating mechanism can be classified into three categories. One is that, the electrical operating mechanism comprises a pinion-and-rack mechanism and a shifting part; the shifting part is connected with the poke rod; a motor is arranged in a bottom box, and the pinion-and-rack mechanism transforms the rotation of the motor into reciprocating action of the shifting part, so that the circuit breaker actuating mechanism is triggered by the poke rod to realize the on/off of the circuit breaker.

Optionally, the electrical operating mechanism comprises: a translational mechanism and a shifting part; the shifting part is connected with the poke rod; the translational mechanism drives the shifting part to make reciprocating motion, so that the circuit breaker actuating mechanism is triggered by the poke rod to realize the on/off of the circuit breaker.

Further optionally, the electrical operating mechanism comprises a crank part and a shifting part, and the shifting part is connected with the poke rod; a motor is arranged in the bottom box, and the rotation of the motor is transformed into reciprocating action of the shifting part through the crank part under the control of the automatic closing control unit, so that the poke rod is switched in the on/off state.

The automatic closing control unit comprises:

a power collection subunit acquiring a power signal from a phase line and conducting rectifying and filtering; and a motor motion control subunit obtaining the power signal, allowing the motor to move when receiving the closing command, and ultimately realizing the closing action of the circuit breaker actuating mechanism.

To have protection function at short circuit or abnormal electricity conditions, the automatic closing control unit further comprises:

a short-circuit detection circuit used for detecting whether a short circuit occurs as well as generating a tripping control signal when a short circuit occurs; and a tripping subunit used for allowing the circuit breaker actuating mechanism to generate switch-off action after receiving the tripping control signal.

To prevent the circuit breaker from switching on automatically under the condition without eliminating the abnormal conditions, the automatic closing control unit further comprises: a self-locking control subunit; the self-locking control subunit is connected with the motor motion control subunit and receives a self-locking control signal (indicating the short-circuit conditions) output by the short-circuit detection subunit, so that the motor motion control subunit enables the motor does not to generate action.

To achieve the remote control, for example, for prepayment, the automatic closing control unit further comprises an external control unit; the external control unit is connected with the tripping subunit and the motor motion control subunit respectively and receives an external control signal, so as to control the tripping device and the motor.

The short-circuit detection circuit comprises at least a short-circuit detection element arranged for at least one phase line and connected with a decision element, and the decision element generates the self-locking control signal and the tripping control signal according to the state of the short-circuit detection element in the case of short circuit.

The automatic closing control unit further comprises a temperature detection subunit for detecting the temperature of the phase line and generates a self-locking control signal and/or tripping control signal when the temperature reaches the threshold value.

The temperature detection subunit comprises a temperature detection element arranged for at least one phase line and connected with the decision element, and the decision element generates the self-locking control signal and/or tripping control signal according to the state of the temperature detection element at the abnormal temperature.

The automatic closing control unit further comprises a limit subunit which sends out a control signal to the motor motion control subunit after the circuit breaker is closed, so as to enable the motor to stop.

The limit subunit comprises a photoelectric coupler, and after the circuit breaker is closed, a stage change is generated at the output terminal and transmitted to the motor motion control subunit to enable the motor to stop.

Compared with the prior art, the invention has the benefits that the automatic closing of the circuit breaker can be realized, the circuit breaker can be disconnected when a short circuit occurs, the temperature is too high or other abnormal electricity conditions occur, and the circuit breaker cannot be automatically closed under the condition without eliminating the abnormal conditions, thus the built-in circuit breaker and the intelligent circuit breaker are suitable for the remote control of the circuit breaker and are basic products for the development of the smart grid.

DETAILED DESCRIPTION OF THE EMBODIMENTS

The invention is explained in further detail below with reference to the attached drawings.

It should be noted that, the structures of a built-in circuit breaker with automatic closing function according to the embodiments of the invention are applicable to an intelligent breaker with automatic closing function.

Figure 1:
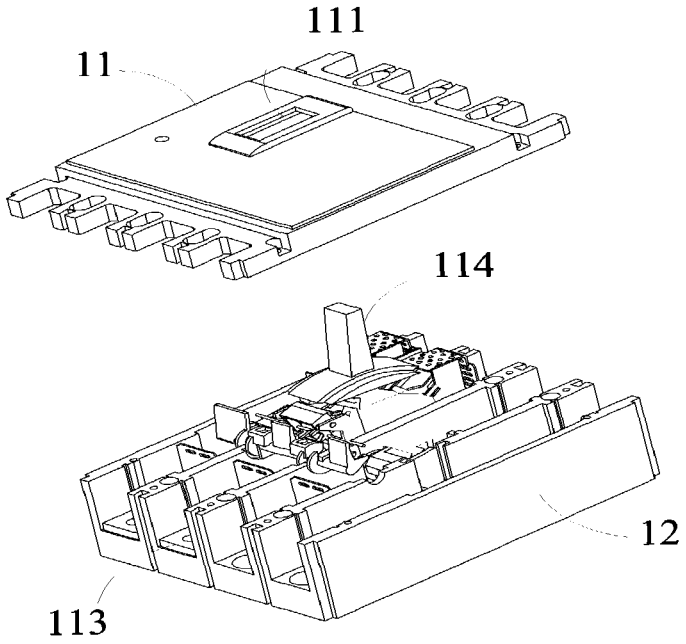
FIG. 1 (Prior art)
FIG. 1 is an exploded view of a circuit breaker in the prior art.
Figure 2:
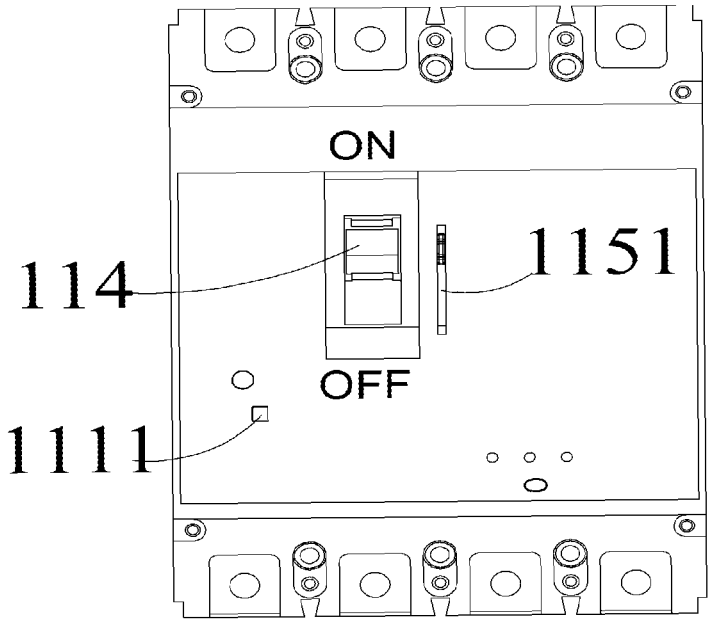
FIG. 2 is a front view of a built-in circuit breaker with automatic closing function in accordance with one embodiment of the invention.

As shown in FIG. 2 for a front view of a built-in circuit breaker with automatic closing function. The built-in circuit breaker with automatic closing function comprises a circuit breaker body, wherein the circuit breaker body comprises a box body, the box body comprises an upper cover 11, a bearing plate 10 and a bottom box 12, and the bottom box 12 is provided with a wire inlet port 115 and a wire outlet port 113 for realizing the leading-in and leading-out of the phase lines and zero lines; a longitudinal partition board is arranged between every two incoming lines (phase line and zero line) for separation, and is internally connected with a leading-in metal sheet.

The circuit breaker actuating mechanism comprises a handle 114 and a linkage component connected with the handle 114, wherein a movable contact arm is hinged at the lower end of a linkage rod of the linkage component, when the linkage component rotates under the action of the handle 114, the movable contact arm is driven to rotate, a moving contact on the movable contact arm is in contact with a stationary contact on a static contact piece, and the static contact piece is connected with a wire outlet end on the bottom box, so that the purpose of transmitting current out (in the prior art) is achieved.

The built-in circuit breaker with automatic closing function comprises a mechanical part and a control part, and as to the automatic closing function, an automatic closing mechanical unit and an automatic closing control unit can be included. The built-in circuit breaker with automatic closing function comprises a circuit breaker body. The circuit breaker body comprises an upper cover 11. A notch groove 111 is formed on the upper cover, and two ends of the notch groove 111 are positioned in the on/off position correspondingly to the circuit breaker; the handle 114 extends out of the notch groove 111.

Figure 3A:
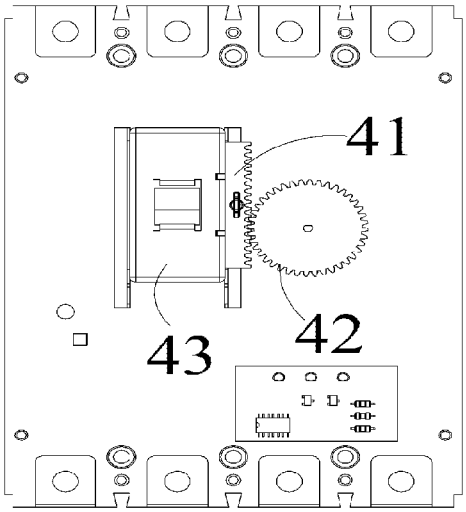
FIG. 3A is a front view of an automatic closing mechanical unit of a built-in circuit breaker in accordance with embodiment 1 of the invention, with an upper cover taken down.
Figure 3B:
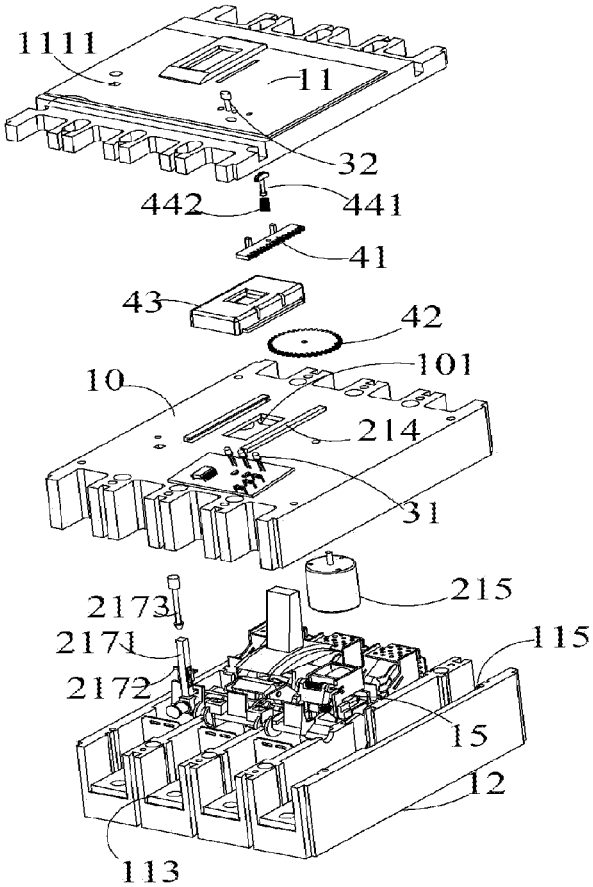
FIG. 3B is a three-dimensional exploded view of an automatic closing mechanical unit of a built-in circuit breaker in accordance with embodiment 1 of the invention.

As shown in FIG. 3A and FIG. 3B for a front view and a three-dimensional exploded view of Embodiment 1 of the automatic closing mechanical unit of the built-in circuit breaker with automatic closing function, with the upper cover taken down. The built-in circuit breaker with automatic closing function comprises a bearing plate 10, wherein the bearing plate 10 is arranged between the upper cover 11 and the bottom box 12 and combined with an electrical operating mechanism, the electrical operating mechanism is provided with an execution end connected with the handle 114, and the handle 114 is further switched in the on/off state during the operation of the electrical operating mechanism under the control of the automatic closing control unit.

The electrical operating mechanism comprises a motor 215 and an intermediate transmission mechanism, wherein the intermediate transmission mechanism is arranged on the bearing plate 10 and comprises a pinion-and-rack mechanism and a shifting part 43, and the shifting part 43 is connected with the handle 114; the motor 215 is arranged in the bottom box 12, and the rotation of the motor 215 is transformed into reciprocating action of the shifting part 43 through the pinion-and-rack mechanism, so that the handle 114 is switched in the on/off state.

The shifting part 43 is a frame body, the handle 114 penetrates the middle of the frame body of the shifting part 43, and slide rails capable of moving along a chute 214 are arranged on two sides of the frame body of the shifting part 43.

The pinion-and-rack mechanism comprises:

A rack 41 combined with the frame body of the shifting part 43 and capable of driving the frame body of the shifting part 43 to make reciprocating motion;

A first gear 42 arranged on the bearing plate 10 and meshed with the rack 41; an output shaft of the motor 215 is connected with the first gear 42.

The pinion-and-rack mechanism further comprises a pinion-and-rack separation subunit used for separating the pinion and rack. At least one guide limit groove is formed on a lateral wing of the frame body 43; the guide limit groove is longitudinal, the pinion-and-rack separation subunit comprises:

- a guide limit block (there is one in this example, two or more is also acceptable) at least arranged on a lateral wing of the rack 41 and corresponding to the guide limit groove; and
- a traction component arranged on the rack as well as allowing the rack to move up and down along the guide limit groove.

The traction component comprises:

- a towing pad arranged on the rack;
- a traction rod 441 penetrating the towing pad; a traction handle arranged at the upper end of the traction rod; and
- an elastic component 442 sleeved on the traction rod and used for realizing the resetting of the traction handle.

The elastic component 442 is a spring. A notch 1151 is formed on the upper cover, the traction handle penetrates the notch, and the lower end is propped against the upper cover after the traction handle is pulled up. When the traction rod 441 is pulled up, the rack 41 is driven to move along the guide limit groove. Thus, the rack 41 is separated from the first gear 42 and the handle 114 can be operated manually.

More preferably, the pinion-and-rack mechanism further comprises a speed reducer; the speed reducer is arranged on the output shaft of the motor 215, and an output shaft of the speed reducer is fixedly connected with the first gear 42.

More preferably, a safety switch 32 is arranged on the upper cover 11 and corresponds to a corresponding latching switch on the automatic closing control unit, so as to prevent the circuit breaker from being closed under the action of the motor 215 during the maintenance.

More preferably, a plurality of status indicator lamps 31 are arranged on a circuit control board 3, and correspond to through holes reserved on the upper cover 11 after the upper cover 11 is installed.

A tripping device 15 is arranged on the bottom box 12, and the action end of the tripping device 15 is connected with the linkage rod of the linkage component through a connecting rod. When the tripping device 15 obtains a corresponding control signal from a control circuit on the circuit control board 3, a tripping action is generated, that is, the action end of the tripping device 15 pushes the linkage rod to move, and the moving contact is further separated from the stationary contact. The tripping device 15 is an electromagnet, and the action end of the tripping device 15 serves as its armature end.

When any abnormal condition of short-circuit or overcurrent occurs, more preferably, a mechanical self-locking mechanism can also be included. The mechanical self-locking mechanism comprises a limit rod 2171, wherein a hooked part is arranged at one end of the limit rod 2171 and hooked in a groove formed on an axial linkage rod, the axial linkage rod can swing and is propped against with a linkage block of the linkage component, and the other end of the limit rod 2171 can extend out (It at least is aligned with the hole 1111 and does not extend out) from a hole 1111 formed on the upper cover 11; a through groove is formed in the middle of the limit rod 2171, a fixing part 2172 is fixedly connected with the upper cover 11 from the lower part, and penetrates the through groove, and a return spring is arranged in the through groove; when an abnormal condition occurs, the tripping device moves for triggering the axial linkage rod to rotate, the linkage block of the linkage component is driven to rotate, the moving contact is further separated from the stationary contact, the hooked part of the limit rod 2171 slips out of the groove at the moment, the limit rod 2171 moves upwards under the action of the return spring arranged in the through groove, and extends out of the hole 1111 on the upper cover, and the hooked part is propped against the axial linkage rod, so that the resetting is failed, that is, the self-locking is formed. In that situation, the indication effect of the extending limit rod 2171 shows that the off state of the present circuit breaker is caused by abnormality, and if the circuit breaker is expected to be closed, the extending limit rod 2171 is artificially pressed back through a rod 2173, and the hooked part is newly embedded in the groove, so as to realize unlocking.

Certainly, the above adopts mechanical self-locking, and when the electronic self-locking is adopted, the artificial unlocking is not required generally, thus it is more convenient and more timely.

Figure 4A:
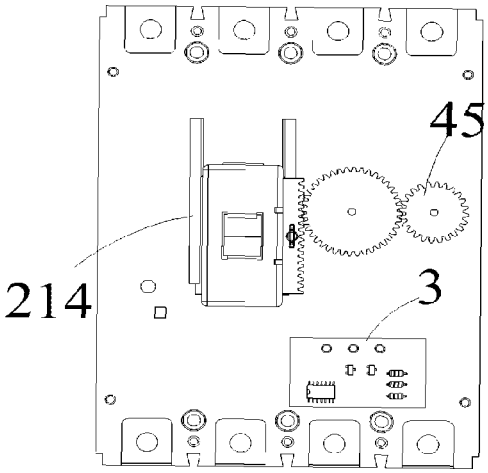
FIG. 4A is a front view of an automatic closing mechanical unit of a built-in circuit breaker in accordance with embodiment 2 of the invention, with an upper cover taken down.
Figure 4B:
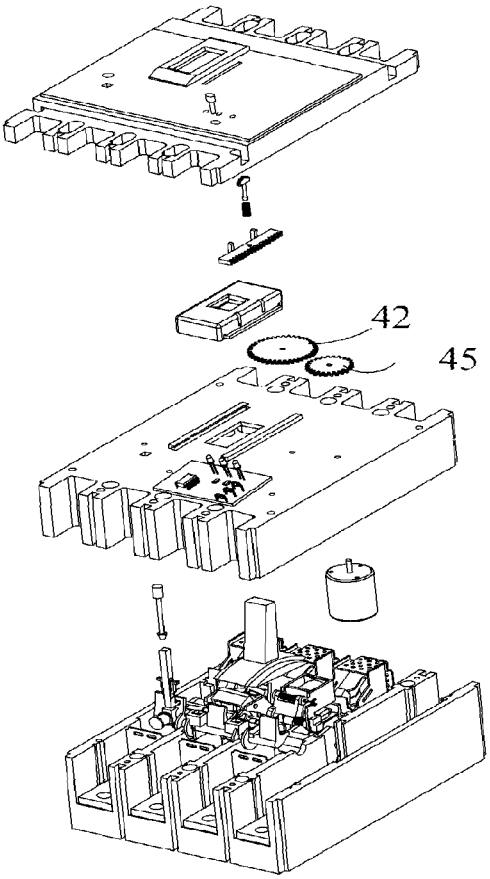
FIG. 4B is a three-dimensional exploded view of an automatic closing mechanical unit of a built-in circuit breaker in accordance with embodiment 2 of the invention.

As shown in FIG. 4A and FIG. 4B for a front view and a three-dimensional exploded view of Embodiment 2 of the automatic closing mechanical unit of the built-in circuit breaker with automatic closing function, with the upper cover taken down. The difference from Embodiment 1 lies in that the two-stage gear transmission mode is adopted here, a second gear 45 is also included, and the second gear 45 is arranged on the bearing plate 10 and meshed with the first gear 42. The motor 215 positioned in the bottom box 12 is fixedly connected with the second gear 45.

Figure 5A:
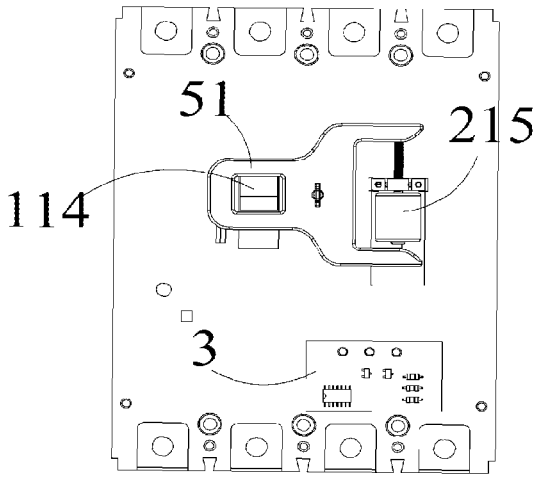
FIG. 5A is a front view of an automatic closing mechanical unit of a built-in circuit breaker in accordance with embodiment 3 of the invention, with an upper cover taken down.
Figure 5B:
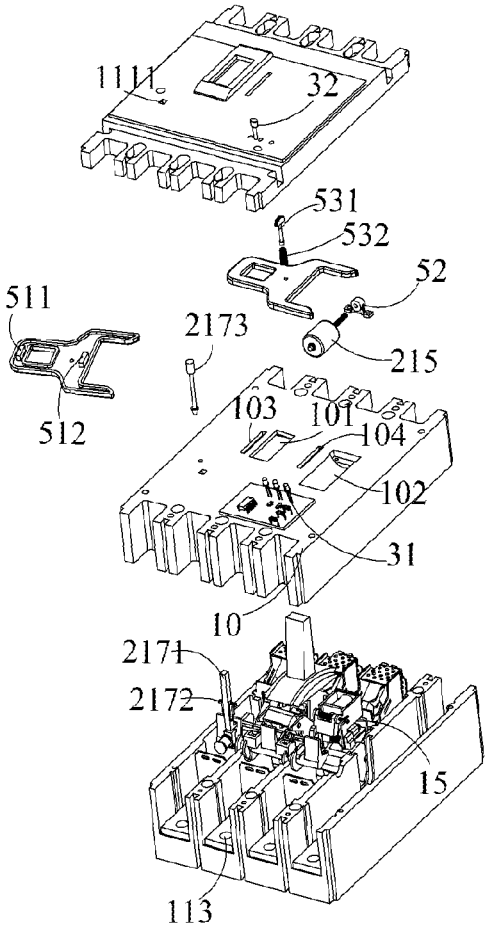
FIG. 5B is a three-dimensional exploded view of an automatic closing mechanical unit of a built-in circuit breaker in accordance with embodiment 3 of the invention.

As shown in FIG. 5A and FIG. 5B for a front view and a three-dimensional exploded view of Embodiment 3 of the automatic closing mechanical unit of the built-in circuit breaker with automatic closing function, with the upper cover taken down. The difference from Embodiment above mainly lies in that the electrical operating mechanism comprises a translational mechanism and a shifting part which are arranged on the bearing plate, and the shifting part is propped against the handle 114;

The translational mechanism pushes the shifting part to make reciprocating motion, so that the handle 114 is switched in the on/off state.

The shifting part adopts a shift fork 51, a shift opening is formed at one end of the shift fork 51, the handle 114 is arranged in the shift opening, and a push opening is formed at the other end of the shift fork 51. A first guide groove 103 and a second guide groove 104 which are parallel to the notch groove 11 are formed on the bearing plate 10, and a first bulge 511 and a second bulge 512 are arranged on the bottom surface of the shift fork 51 and embedded in the guide grooves respectively.

The translational mechanism comprises:

A motor 215; a threaded column is arranged on an output shaft of the motor 215 and provided with an end, and a propping part is arranged on the bottom side of the motor 215; a notch groove 102 is formed on the bearing plate 10, and the motor 215 is arranged in the notch groove 102;

A guide support seat 52; the guide support seat 52 is arranged on the bearing plate 10 and provided with an inner threaded opening, and the threaded column is screwed into the inner threaded opening; and the end of the threaded column and the propping part correspond to the two inner side walls of the push opening of the shift fork 51 respectively.

The translational mechanism further comprises a lifting separation mechanism for separating the shift fork 51 and the spiral pushing translational mechanism.

The lifting separation mechanism comprises:

a towing pad arranged at the middle of the shift fork 51;

a traction rod 531 penetrating the towing pad, a traction handle arranged at the upper end of the traction rod 531; and an elastic component 532 sleeved on the traction rod and used for realizing the resetting of the traction handle, the elastic component 532 is a spring.

A notch 16 is formed on the upper cover 11, the traction handle penetrates the notch, and the lower end is propped against the upper cover after the traction handle is pulled up.

When the motor 215 rotates, it horizontally moves relative to the guide support seat 52 and is propped against the push opening of the shift fork 51, and the shift fork 51 moves along the first guide groove 103 and the second guide groove 104, so that the handle 114 is switched in the on/off state.

Figure 6A:
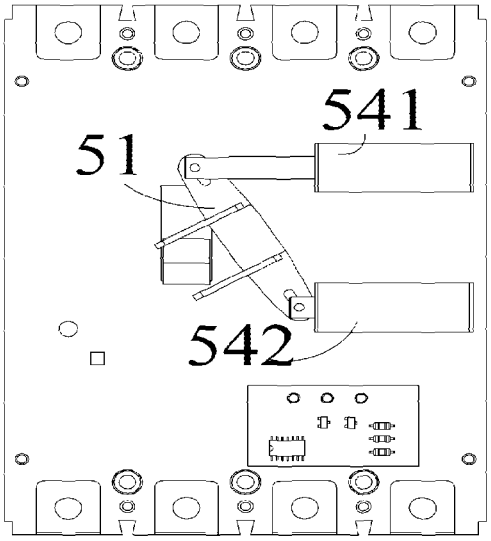
FIG. 6A is a front view of an automatic closing mechanical unit of a built-in circuit breaker in accordance with embodiment 4 of the invention, with an upper cover taken down.
Figure 6B:
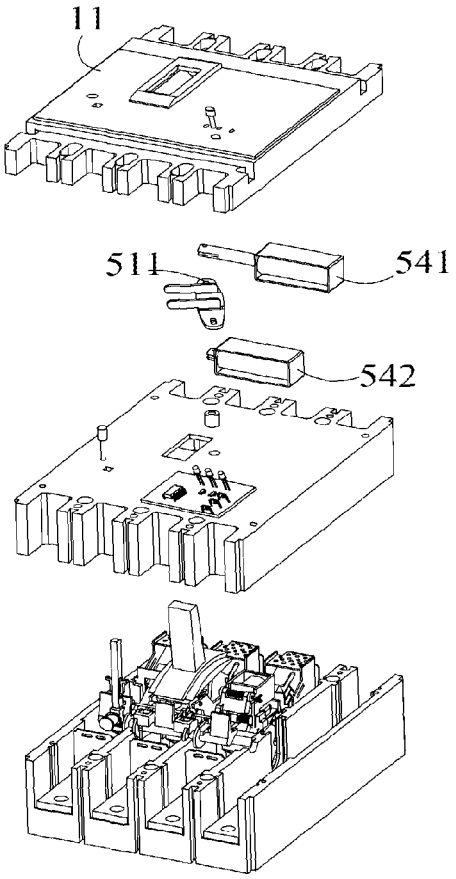
FIG. 6B is a three-dimensional exploded view of an automatic closing mechanical unit of a built-in circuit breaker in accordance with embodiment 4 of the invention.

As shown in FIG. 6A and FIG. 6B for a front view and a three-dimensional exploded view of Embodiment 4 of the automatic closing mechanical unit of the built-in circuit breaker with automatic closing function, with the upper cover taken down. The difference from Embodiment 3 lies in that the shifting part adopts a shift fork 51, a shift opening is formed at one end of the shift fork 51, the handle 114 is arranged in the shift opening, connecting holes 511 are formed on two wings of the shift fork, and the middle of the shift fork 51 is coupled with the bearing plate 10.

The translational mechanism comprises a pair of electromagnets 541 and 542, which are fixedly arranged on the bearing plate 10; the armature ends of the two electromagnets 541 and 542 are hinged with the connecting holes 511; the two electromagnets 541 and 542 are not in the same working states, that is, one electromagnet is in the state that the armature extends out, and the other electromagnet is in the state that the armature does not extend out, so that a link mechanism is formed between the translational mechanism and the shift fork, that is, the purpose of switching the handle 114 in the on/off state is achieved through the alternant changes in state of the two electromagnets 541 and 542.

Figure 7A:
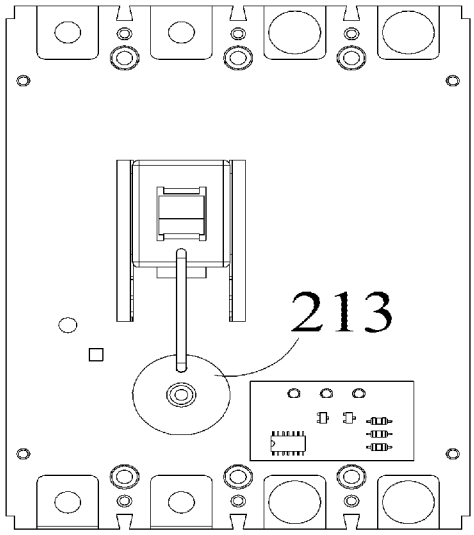
FIG. 7A is a front view of an automatic closing mechanical unit of a built-in circuit breaker in accordance with embodiment 5 of the invention, with an upper cover taken down.
Figure 7B:
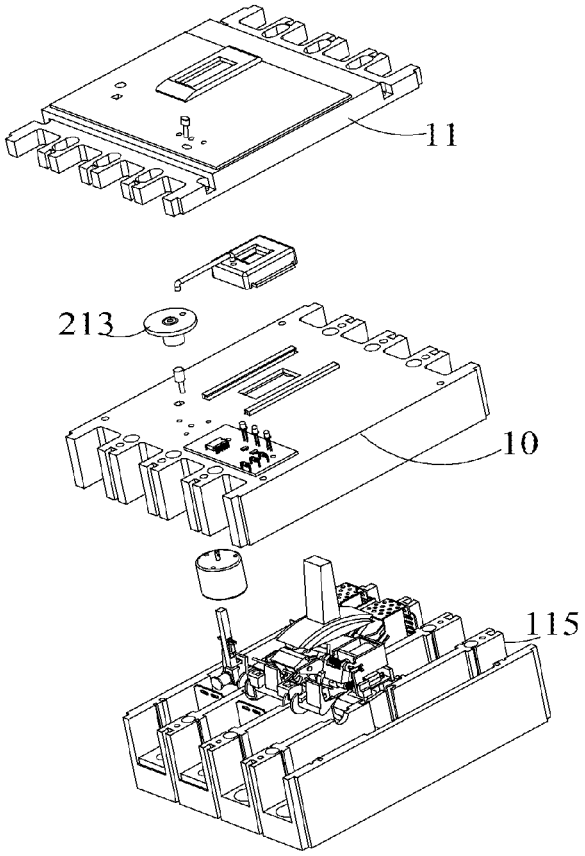
FIG. 7B is a three-dimensional exploded view of an automatic closing mechanical unit of a built-in circuit breaker in accordance with embodiment 5 of the invention.

As shown in FIG. 7A and FIG. 7B for a front view and a three-dimensional exploded view of Embodiment 5 of the automatic closing mechanical unit of the built-in circuit breaker with automatic closing function, with the upper cover taken down. The difference from the embodiment above mainly lies in that the electrical operating mechanism comprises a crank part and a shifting part, and the shifting part is connected with the handle 114; a motor 215 is arranged in the bottom box 12, and the rotation of the motor 215 is transformed into reciprocating action of the shifting part through the crank part under the control of the automatic closing control unit, so that the handle is switched in the on/off state.

The crank part in the embodiment comprises a ratchet-pawl mechanism and a connecting rod; the ratchet-pawl mechanism comprises a housing, a core and a rolling bearing; the housing is provided with an internal tooth, the internal tooth adopts a ratchet, and a connecting hole is formed on the disc surface of the housing; the core is arranged in the internal tooth, at least one pawl is arranged on the outer edge of the core, an elastic element is arranged between the pawl and the core, and the pawl corresponds to the ratchet; the rolling bearing is arranged between the housing and the core.

The shifting part is a frame body 211, the handle 114 penetrates the middle of the frame body 211, slide rails capable of sliding along a chute 214 are arranged on two sides of the frame body 211, and a connecting hole is formed on the frame body 211; the connecting rod 212 is arranged between the connecting hole of the housing and the connecting hole of the frame body 211, and the output shaft of the motor 215 is arranged in a shaft hole of the core; when the motor 215 rotates, the core drives the housing to rotate, and the connecting rod 212 further pulls or pushes the shifting part to move along the chute 214, so that the handle 114 is switched in the on/off state.

Figure 8A:
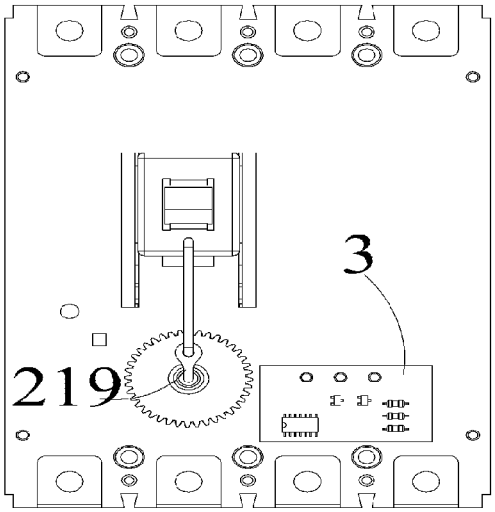
FIG. 8A is a front view of an automatic closing mechanical unit of a built-in circuit breaker in accordance with embodiment 6 of the invention, with an upper cover taken down.
Figure 8B:
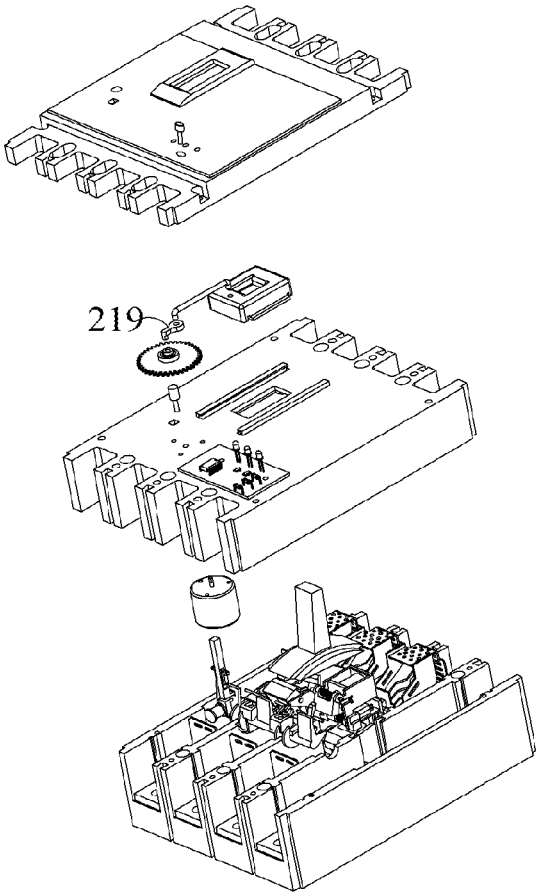
FIG. 8B is a three-dimensional exploded view of an automatic closing mechanical unit of a built-in circuit breaker in accordance with embodiment 6 of the invention.

As shown in FIG. 8A and FIG. 8B for a front view and a three-dimensional exploded view of Embodiment 6 of the automatic closing mechanical unit of the built-in circuit breaker with automatic closing function, with the upper cover taken down. The difference from Embodiment 5 lies in that a connecting hole is not obliquely formed on the housing any more, however, an adapting rod 219 is additionally arranged, one end of the adapting rod 219 is fixedly arranged at the middle of the housing, a connecting hole is formed at the other end of the adapting rod 219, the connecting rod 212 is arranged between the connecting hole of the adapting rod 219 and the connecting hole of the frame body 211, and the output shaft of the motor 215 is arranged in the shaft hole of the core; when the motor rotates, the core drives the housing to rotate, and the adapting rod 219 further drives the connecting rod 212 to pull or push the shifting part to move along the chute 214, so that the handle 114 is switched in the on/off state.

Figure 9A:
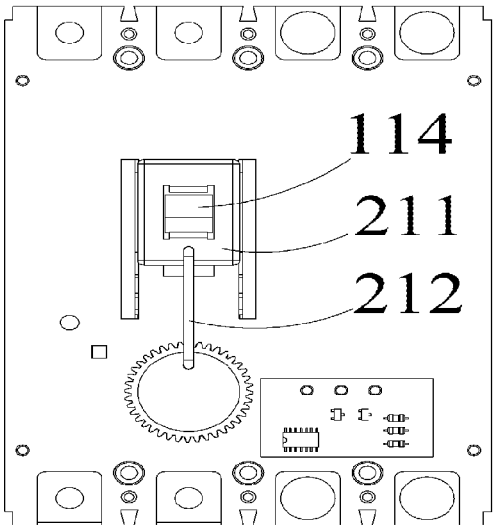
FIG. 9A is a front view of an automatic closing mechanical unit of a built-in circuit breaker in accordance with embodiment 7 of the invention, with an upper cover taken down.
Figure 9B:
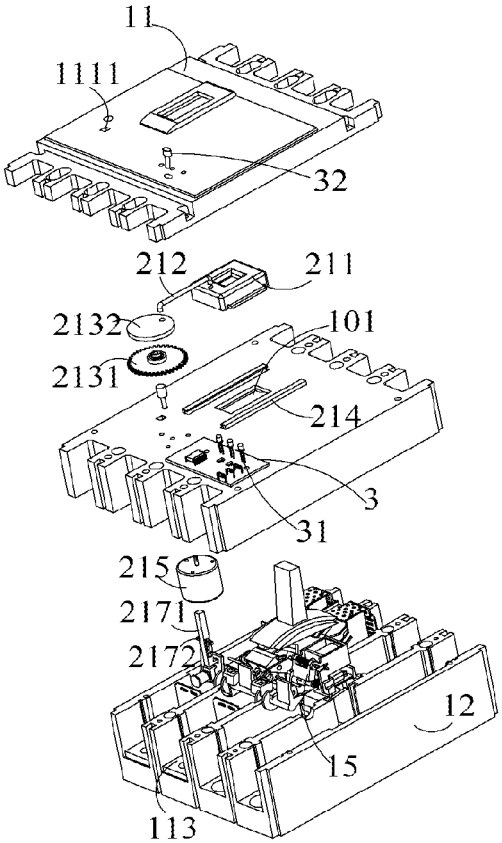
FIG. 9B is a three-dimensional exploded view of an automatic closing mechanical unit of a built-in circuit breaker in accordance with embodiment 7 of the invention.

As shown in FIG. 9A and FIG. 9B for a front view and a three-dimensional exploded view of Embodiment 7 of the automatic closing mechanical unit of the built-in circuit breaker with automatic closing function, with the upper cover taken down. The difference from Embodiment 5 lies in that a connecting hole is not obliquely formed on the housing 2131 any more, however, a disc 2132 is additionally arranged and fixedly arranged on the housing 2131, a connecting hole is obliquely formed on one side of the disc 2132, the connecting rod 212 is arranged between the connecting hole of the disc 2132 and the connecting hole of the frame body 211, and the output shaft of the motor 215 is arranged in the shaft hole of the core; when the motor 215 rotates, the core drives the housing 2131, and the disc 2132 further drives the connecting rod 212 to pull or push the shifting part to move along the chute 214, so that the handle 114 is switched in the on/off state.

Figure 10A:
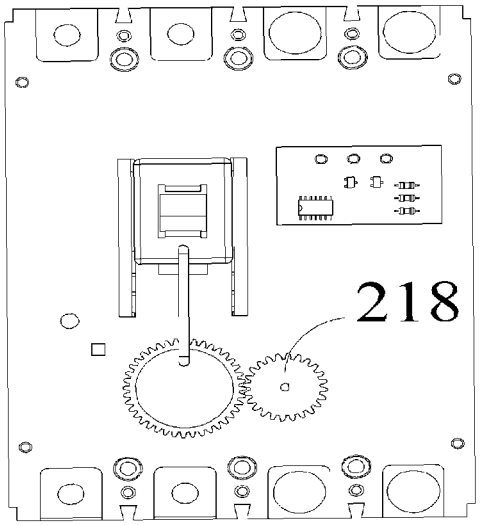
FIG. 10A is a front view of an automatic closing mechanical unit of a built-in circuit breaker in accordance with embodiment 8 of the invention, with an upper cover taken down.
Figure 10B:
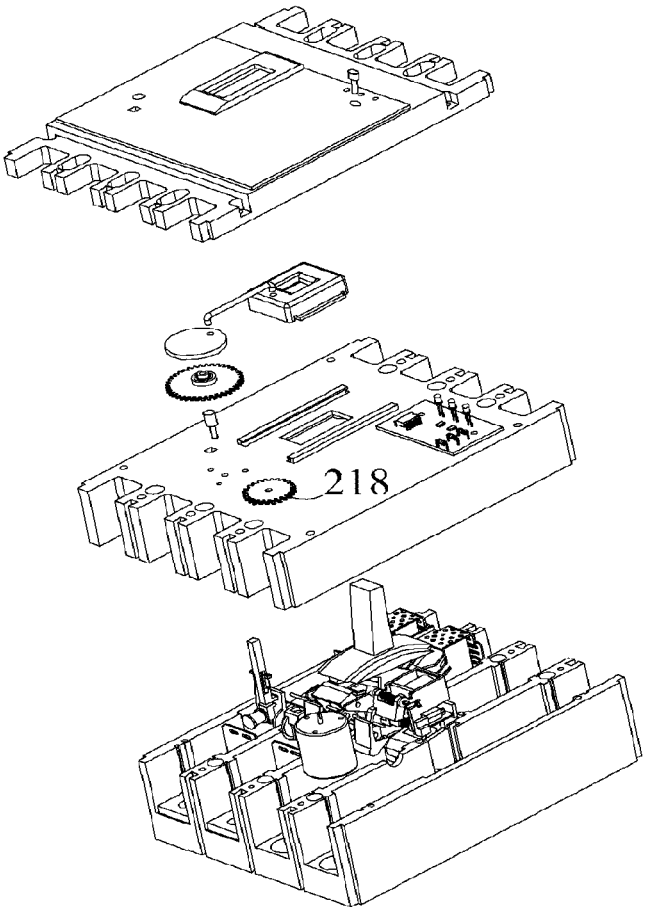
FIG. 10B is a three-dimensional exploded view of an automatic closing mechanical unit of a built-in circuit breaker in accordance with embodiment 8 of the invention.

As shown in FIG. 10A and FIG. 10B for a front view and a three-dimensional exploded view of Embodiment 8 of the automatic closing mechanical unit of the built-in circuit breaker with automatic closing function, with the upper cover taken down. The difference from Embodiment 7 lies in that a gear 218 is also included, the gear 218 is arranged on the bearing plate 10 and connected with the output shaft of the motor 215, teeth are arranged on the outer edge of the housing 2131, and the gear 218 is meshed with the housing 2131; when the motor 215 rotates to drive the gear 218 to rotate, the housing 2131 is driven to rotate, the disc 2132 further drives the connecting rod 212 to pull or push the shifting part to move along the chute 214, and ultimately, the handle 114 is switched in the on/off state.

Figure 11A:
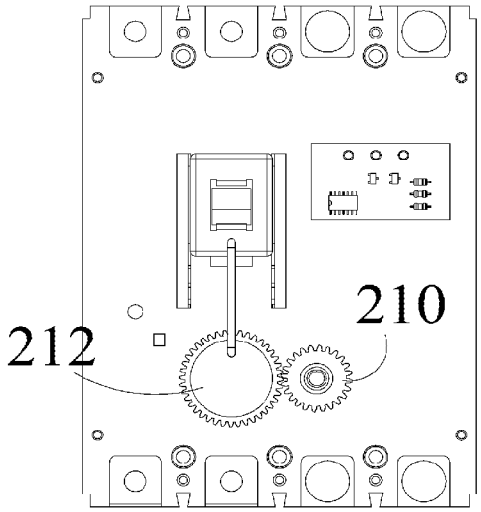
FIG. 11A is a front view of an automatic closing mechanical unit of a built-in circuit breaker in accordance with embodiment 9 of the invention, with an upper cover taken down.
Figure 11B:
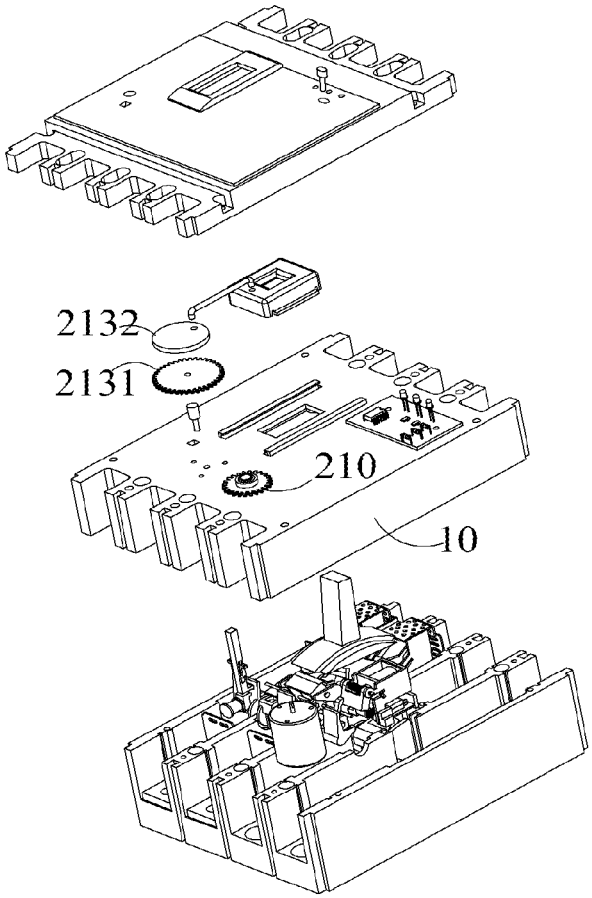
FIG. 11B is a three-dimensional exploded view of an automatic closing mechanical unit of a built-in circuit breaker in accordance with embodiment 9 of the invention.

As shown in FIG. 11A and FIG. 11B for a front view and a three-dimensional exploded view of Embodiment 9 of the automatic closing mechanical unit of the built-in circuit breaker with automatic closing function, with the upper cover taken down. The difference from Embodiment 7 lies in that the positions of the ratchet-pawl mechanism and the gear are exchanged, a disc 2132 is fixedly arranged on a gear 2131, a connecting hole is obliquely formed on the disc 2132, and the core is fixedly connected with the motor (actually, a connecting hole can also be formed on the gear 2131, and then the disc 2132 is not required); when the motor 215 rotates to drive the core to rotate, a housing 210 is driven by the core to rotate, the gear 2131 is further driven to rotate, the disc 2132 further drives the connecting rod 212 to pull or push the shifting part to move along the chute 214, and ultimately, the handle 114 is switched in the on/off state.

Figure 12A:
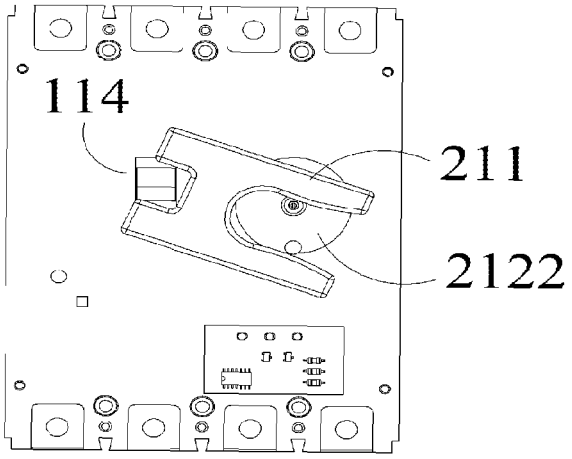
FIG. 12A is a front view of an automatic closing mechanical unit of a built-in circuit breaker in accordance with embodiment 10 of the invention, with an upper cover taken down.
Figure 12B:
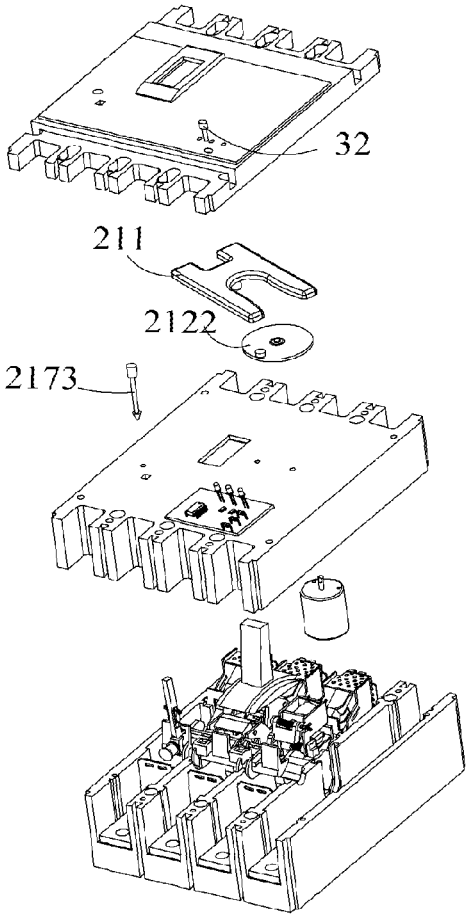
FIG. 12B is a three-dimensional exploded view of an automatic closing mechanical unit of a built-in circuit breaker in accordance with embodiment 10 of the invention.

As shown in FIG. 12A and FIG. 12B for a front view and a three-dimensional exploded view of Embodiment 10 of the automatic closing mechanical unit of the built-in circuit breaker with automatic closing function, with the upper cover taken down. The crank part and the shifting part here have differences with the Embodiments 5-10, the shifting part adopts a shift fork 211, the middle of the shift fork 211 is axially arranged on the bearing plate 10, a shift opening is formed at one end of the shift fork 211, the handle 114 is arranged in the shift opening, and a push opening is formed at the other end of the shift fork 211; a push rod 2123 is obliquely arranged on a housing 212 of the ratchet-pawl mechanism; when the motor 215 rotates to drive the core to rotate, the housing 212 is further driven to rotate, the push rod 2123 further pushes the push opening, the shift fork 211 rotates around an axis, and ultimately, the handle 114 positioned in the shift opening is switched in the on/off state.

Figure 12C:
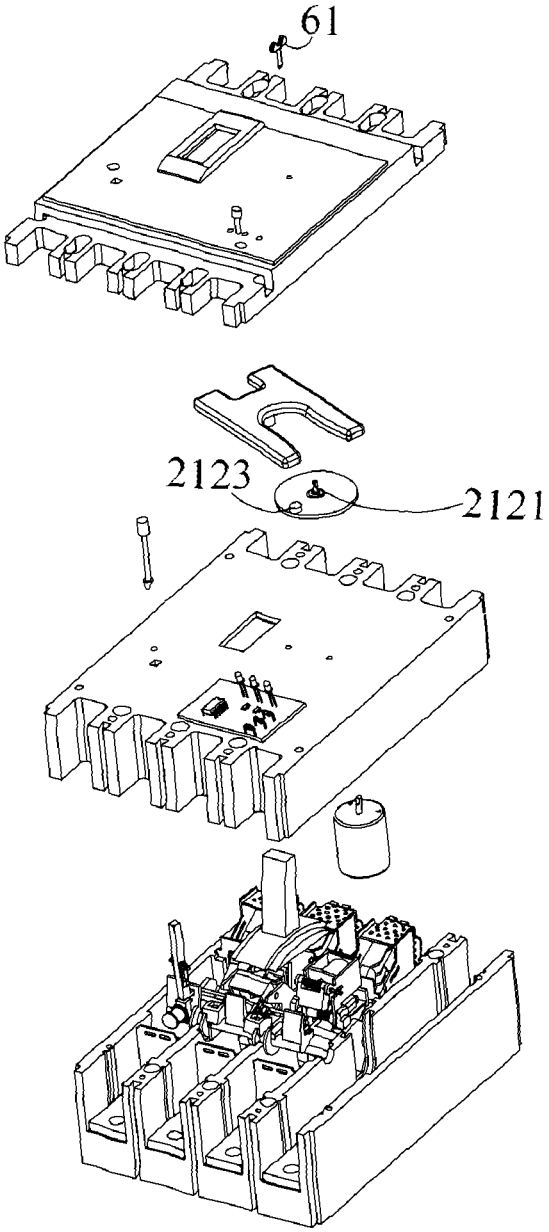
FIG. 12C is a preferable scheme for a three-dimensional exploded view of an automatic closing mechanical unit of a built-in circuit breaker in accordance with embodiment 10 of the invention, with an upper cover taken down.

As shown in FIG. 12C for a preferable scheme for a three-dimensional exploded view of an automatic closing mechanical unit of a built-in circuit breaker in accordance with embodiment 10 of the invention, with an upper cover taken down. The difference between the embodiment of FIG. 12C and the embodiments of FIG. 12A and 12B mainly lies in that in this embodiment, the ratchet-pawl mechanism further comprises an adjusting seat 2121 and an adjusting handle 61; the adjusting seat 2121 is fixedly arranged at the middle of the housing 2123, and a notch groove formed in the middle of the adjusting seat 2121; a bulge at the lower end of the adjusting handle corresponds to the notch groove, and the handle is rotatably adjusted to drive the adjusting seat and the housing to rotate under the non-working state of the pawl. Thus, the handle 114 of the circuit breaker can be operated manually. A notch is formed on the upper cover 11, and the adjusting handle 61 extends in via the notch. It should be noted that, based on the structure of the ratchet-pawl mechanism, the above mentioned embodiments can be adjusted following this embodiment, so that the handle 114 of the circuit breaker can also be operated manually.

Figure 13A:
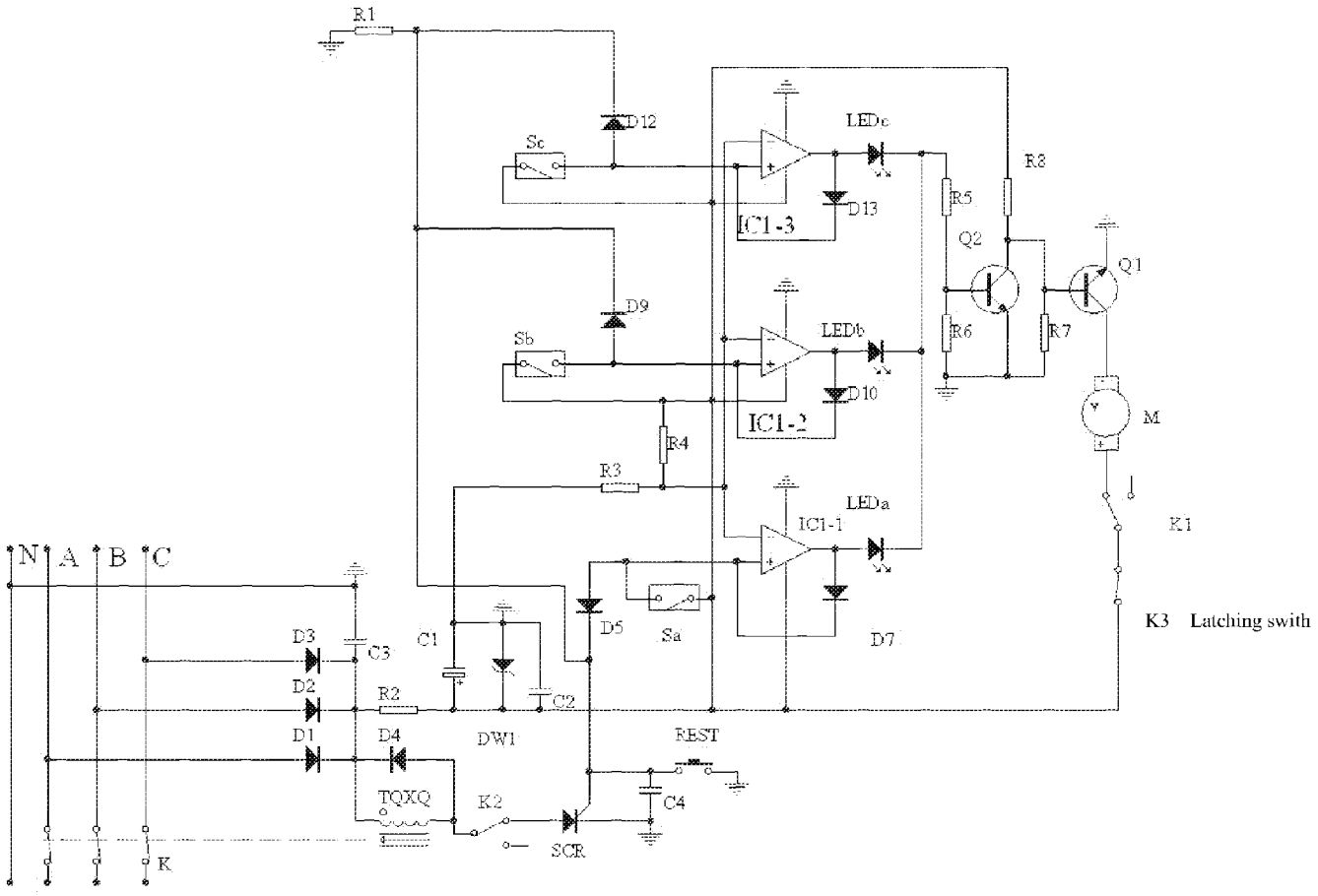
FIG. 13A is a first schematic diagram of an automatic closing control subunit of a control part circuit for a built-in circuit breaker of the invention.

As shown in FIG. 13A for a diagram 1 of the automatic closing control unit of the intelligent circuit breaker with automatic closing function, it's also suitable for a built-in circuit breaker with automatic closing function, and the three-phase circuit breaker is taken as an example in the embodiment. The control circuit comprises: a power collection subunit; the power collection subunit obtains a current signal from the phase line, mainly involving the rectifying and filtering effect to the current of the phase lines, three diodes D1-D3 are adopted and connected with the phase lines A-C, and a capacitor C3 is adopted for filtering;

A voltage regulator circuit; the voltage regulator circuit comprises a voltage-stabilizing tube DW1 and a capacitor C1 and a capacitor C2 which are connected with the voltage-stabilizing tube DW1 in parallel, wherein the cathode of the capacitor C1 is grounded, and the anode of the capacitor C1 is connected with the output terminal of the power collection subunit;

A tripping subunit; when the tripping subunit receives the tripping control signal, the circuit breaker generates switch-off action; the tripping subunit comprises an electromagnet, one end of an electromagnetic coil TQXQ of the electromagnet acquires unidirectional voltage (current) from a power collection circuit, the other end of the electromagnetic coil TQXQ is grounded through a silicon controlled rectifier (SCR), and a capacitor C4 is arranged between the control end of the silicon controlled rectifier (SCR) and the ground;

A short-circuit detection circuit; the short-circuit detection circuit is used for detecting whether a short circuit occurs, and the control signal is output when a short circuit occurs; the short-circuit detection circuit comprises three groups of short-circuit detection elements and a decision element, wherein the short-circuit detection element is used for generating variation in the case of short-circuiting (The reed switches Sa, Sb and Sc are taken as an example), and the decision element (The comparators IC1-1-IC1-3 are taken as an example) is used for obtaining the variation from the short-circuit detection element and comparing the variation with the predetermined benchmark (The number of both and the number of phase lines are consistent); one ends of the reed switches Sa, Sb and Sc are connected with the noninverting terminals of the comparators IC1-1-IC1-3, and the other ends of the reed switches Sa, Sb and Sc are connected with the output terminal of the power connection subunit, so as to be used as comparison signals of the comparators IC1-1-IC1-3; the inverting terminals of the comparators IC1-1-IC1-3 obtain a stable voltage signal as the reference voltage; the embodiment is obtained by adopting a group of divider resistors R3 and R4, wherein one end of the divider resistor R3 is connected with the cathode of the capacitor C1 in the voltage regulator circuit, and the other end of the divider resistor R3 is connected with the output terminal of the power collection subunit; diodes D7, D10 and D13 are arranged between the output terminal and the noninverting terminal of each of the comparators IC1-1-IC1-3; the reed switches Sa, Sb and Sc of each short-circuit detection circuit are connected with the control end of the silicon controlled rectifier (SCR) through diodes D5, D9 and D12, so as to output the tripping control signal to the silicon controlled rectifier (SCR);

A self-locking control subunit; the self-locking control subunit receives the signal (indicating the short-circuit condition) output by a short-circuit detection subunit, so that the motor does not generate action; the self-locking control subunit comprises a first triode Q2, wherein the collecting electrode of the first triode Q2 is connected with the output terminal of the power collection subunit, the emitting electrode of the first triode Q2 is grounded, a pull-up resistor R5 obtains the output signals of the comparators IC1-1-IC1-3 and is connected with the base electrode of the first triode Q2, the base electrode is connected with the ground through a resistor R6, and a resistor R7 is connected between the emitting electrode and the collecting electrode of the first triode Q2;

An automatic closing control subunit of the motor comprises a second triode Q1, wherein the base electrode of the second triode Q1 is connected with the collecting electrode of the first triode Q2, and the emitting electrode of the second triode Q1 is grounded; one end of the motor M is connected with the output terminal of the power collection subunit, and the other end of the motor M is connected with the collecting electrode of the second triode Q1;

More preferably, to accord with the results in the mechanical structure, a limit switch K1 is arranged on a circuit for the automatic closing control subunit of the motor and used for controlling a motor M to stop running after reaching the preset position, so as to ensure the closed position of the circuit breaker;

More preferably, an inspection switch K3 (also called as a latching switch) capable of being manually opened or closed is arranged on the circuit for the automatic closing control subunit of the motor, that is, when the inspection switch K3 is in the off state, the motor M does not generate action under any state;

A tripping subunit reset circuit is also included; the tripping subunit reset circuit comprises a reset key REST, wherein the first end of the reset key REST is connected with the control end of the silicon controlled rectifier (SCR), and the second end of the reset key REST is grounded;

More preferably, light emitting diodes LEDa, LEDb and LEDc are arranged at the output terminals of the comparators IC1-1-IC1-3 and have indication effect.

Figure 13B:
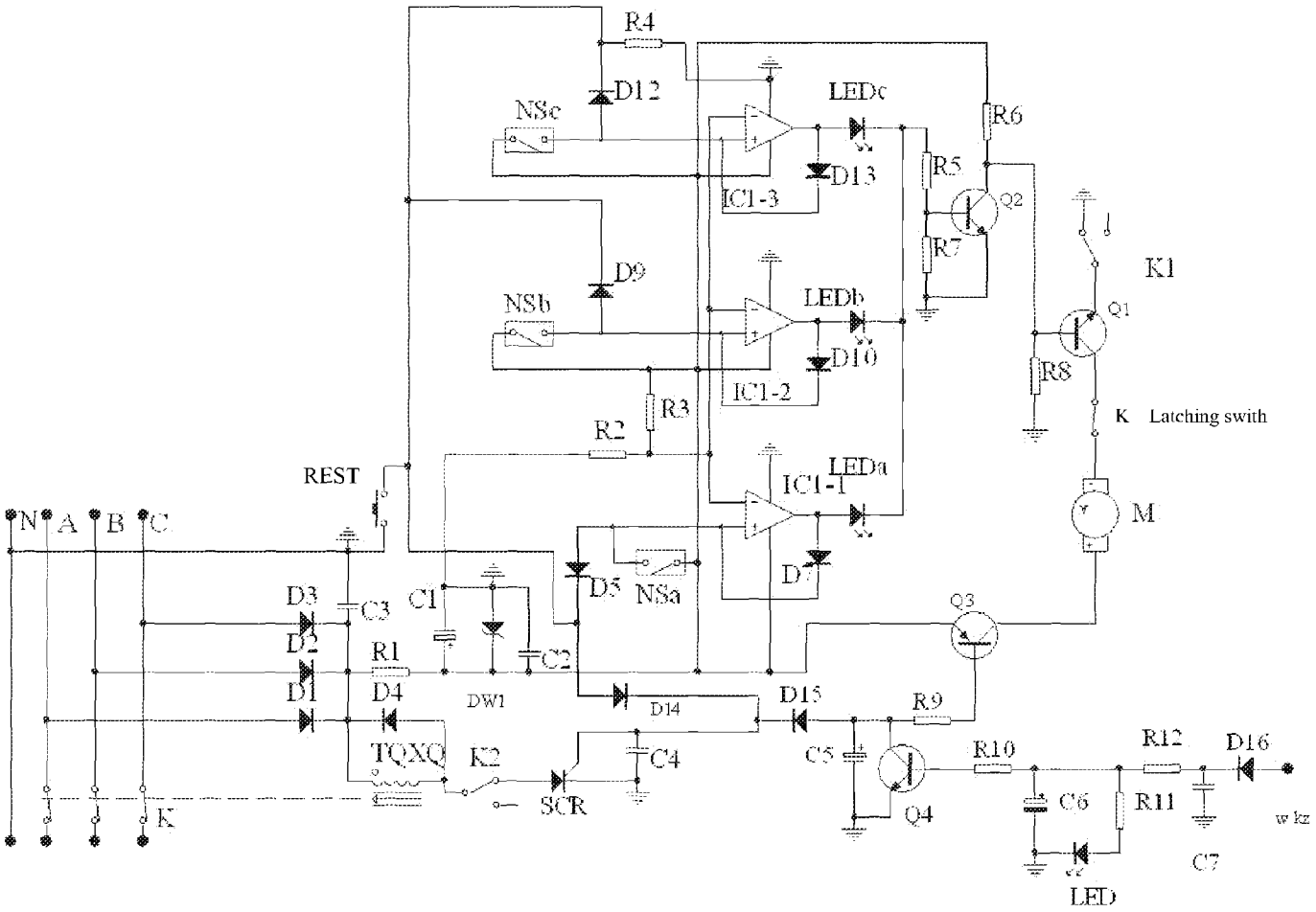
FIG. 13B is a second schematic diagram of an automatic closing control subunit of a control part circuit for a built-in circuit breaker of the invention.

As shown in FIG. 13B for a diagram 2 of the automatic closing control subunit of the intelligent circuit breaker with automatic closing function, it's also suitable for a built-in circuit breaker with automatic closing function, and the difference between the diagram 2 and the diagram 1 lies in that an external control subunit is additionally arranged, so as to meet the demands of the prepayment electrical management system. The external control subunit comprises a unidirectional current component (for example, a diode D16) and a control component, wherein the control component is used for controlling both the tripping subunit and the automatic closing control subunit of the motor; the automatic closing control subunit comprises a third triode Q4 and a fourth triode Q3, wherein the base electrode of the third triode Q4 receives an external control signal, a capacitor C5 is connected between the emitting electrode and the collecting electrode of the third triode Q4, the cathode of the capacitor C5 and the emitting electrode of the third triode Q4 are grounded, and the collecting electrode of the third triode Q4 is connected with the control end of the silicon controlled rectifier (SCR) through a diode D15, that is, when the external signal is in high potential, the tripping device does not generate tripping action; the emitting electrode and the collecting electrode of the fourth triode Q3 (PNP type) are arranged on the circuit for the automatic closing control subunit of the motor M, and the base electrode of the fourth triode Q3 is connected with the collecting electrode of the third triode Q4, that is, when the external control signal is in high potential, the fourth triode Q3 is conducted; when the external control signal is in low potential, the tripping subunit generates tripping action, and meanwhile, the fourth triode Q3 is in the cut-off state, that is, the automatic closing control subunit of the motor does not work.

More preferably, an external control indication circuit is also arranged and comprises an LED, wherein one end of the LED is grounded, the other end of the LED is connected with a resistor R11, and when the external control signal is in high voltage, the LED is in lighted state, otherwise, the LED goes out.

Figure 13C:
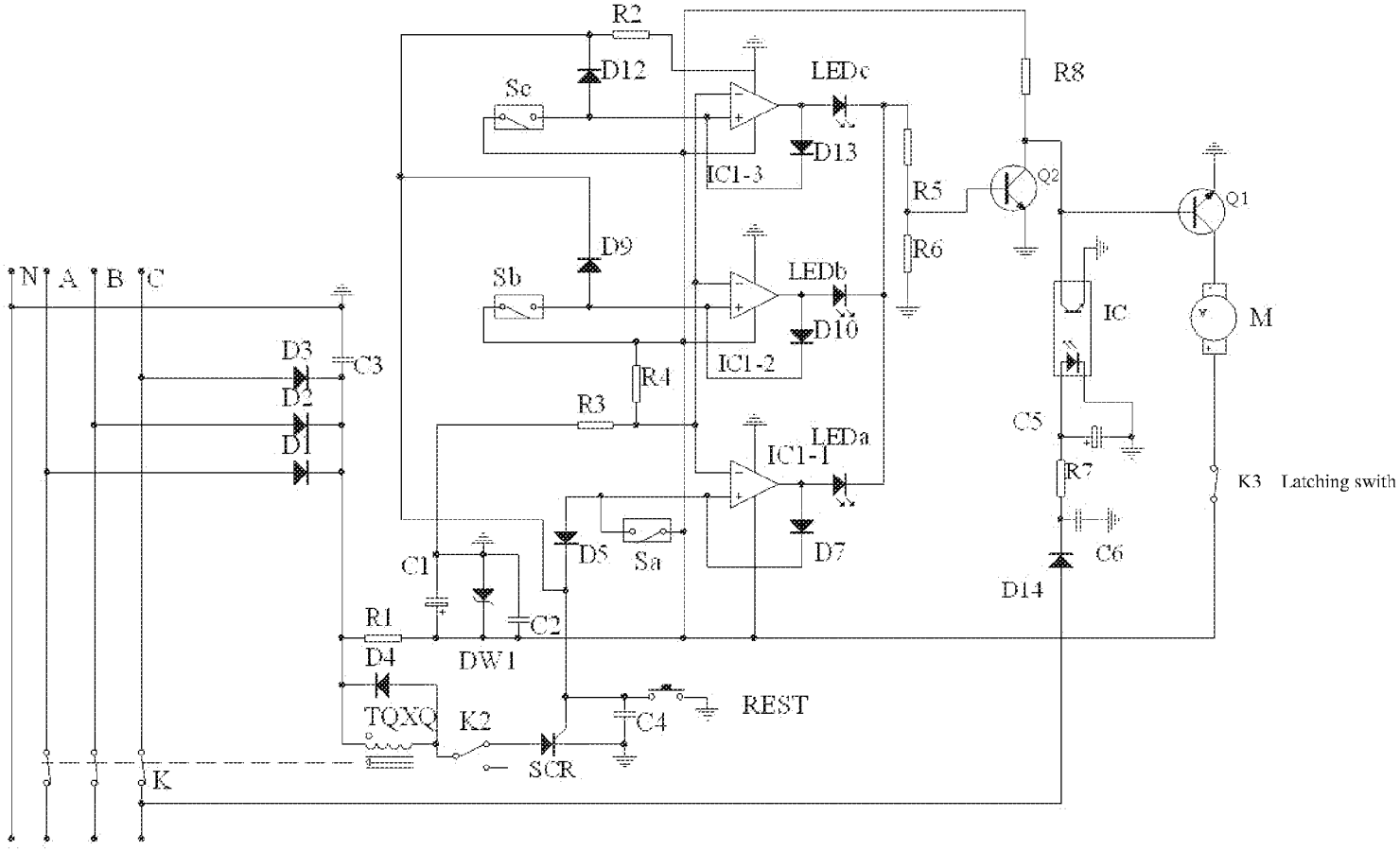
FIG. 13C is a third schematic diagram of an automatic closing control subunit of a control part circuit for a built-in circuit breaker of the invention.
Figure 13D:
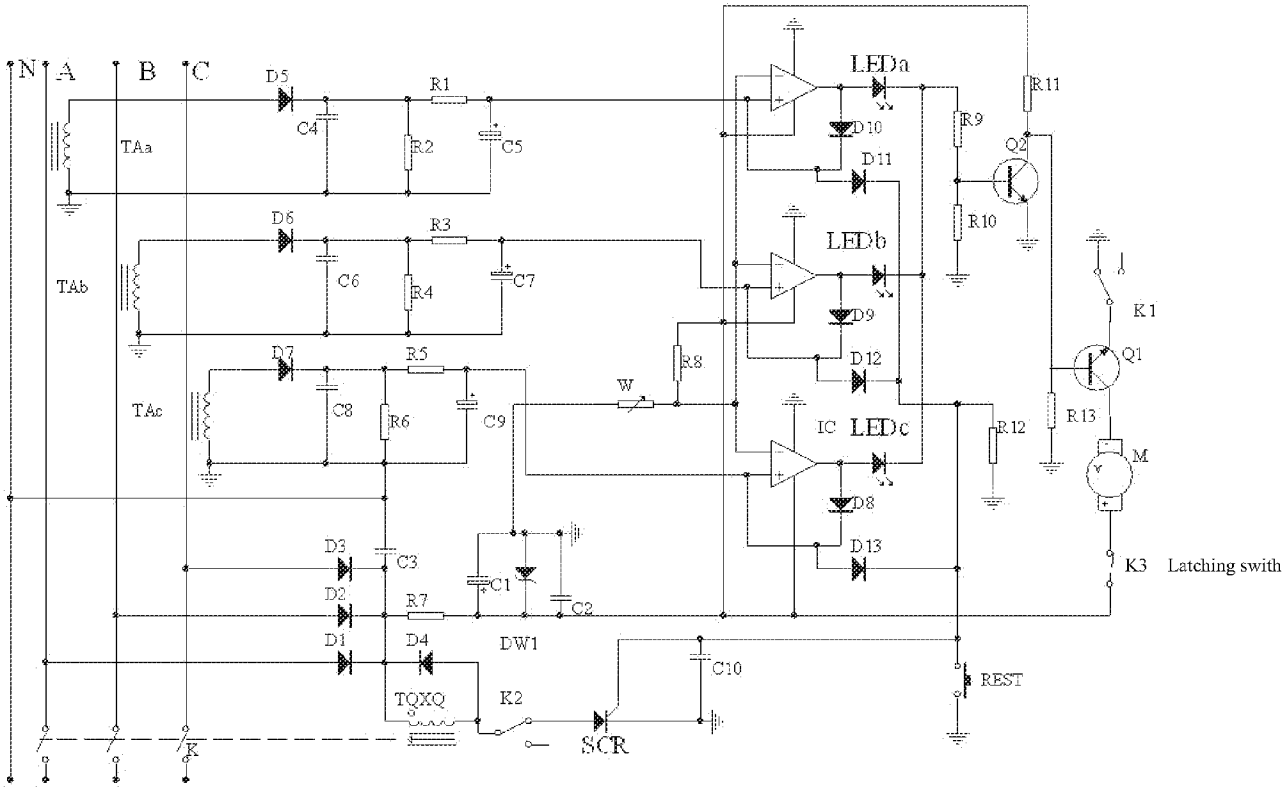
FIG. 13D is a fourth schematic diagram of an automatic closing control subunit of a control part circuit for a built-in circuit breaker of the invention.

As shown in FIG. 13C for a diagram 3 of the automatic closing control subunit of the intelligent circuit breaker with automatic closing function, and the difference from the diagram 1 mainly lies in that a limit subunit is additionally arranged correspondingly, a limit switch is not adopted, so that the space is saved; the limit subunit comprises a photoelectric coupler IC, wherein an input terminal of the photoelectric coupler IC is connected with a phase line through a unidirectional current component (A diode D14 and a voltage dropping resistor R7 are adopted here), the other input terminal of the photoelectric coupler IC is grounded, an output terminal of the photoelectric coupler IC is grounded, and the other output terminal of the photoelectric coupler IC is connected with the base electrode of the second triode Q1; after the motor M is automatically closed, the output terminal of the photoelectric coupler IC outputs low potential, the second triode Q1 is cut-off since the base electrode obtains low potential, the automatic closing control subunit of the motor M is further disconnected, and ultimately, the motor stops running As shown in FIG. 13D for a diagram 4 of the automatic closing control subunit of the intelligent circuit breaker with automatic closing function, it's also suitable for a built-in circuit breaker with automatic closing function, and the difference between the diagram 4 and the diagram 1 mainly lies in that current is detected in the embodiment, thus the reed switches Sa, Sb and Sc are not used any more, however, the current collection component is adopted; current transformers TAa, Tab and Tac are adopted here and arranged on each phase line respectively, voltage signals are converted and transmitted to the comparators IC1-1-IC1-3, and meanwhile, the comparators IC1-1-IC1-3 transmit the output signals to both the self-locking automatic closing control subunit and the control end of the silicon controlled rectifier (SCR) for the tripping subunit; when the abnormal condition of overcurrent occurs, the comparators IC1-1-IC1-3 output high potential signals to the control end of the silicon controlled rectifier (SCR), so that the tripping action is generated, and its necessary to explain the threshold value of an overcurrent comparator is adjustable because the reference voltage of the inverting terminals of the comparators IC1-1-IC1-3 adopts a sliding rheostat w.

Figure 13E:
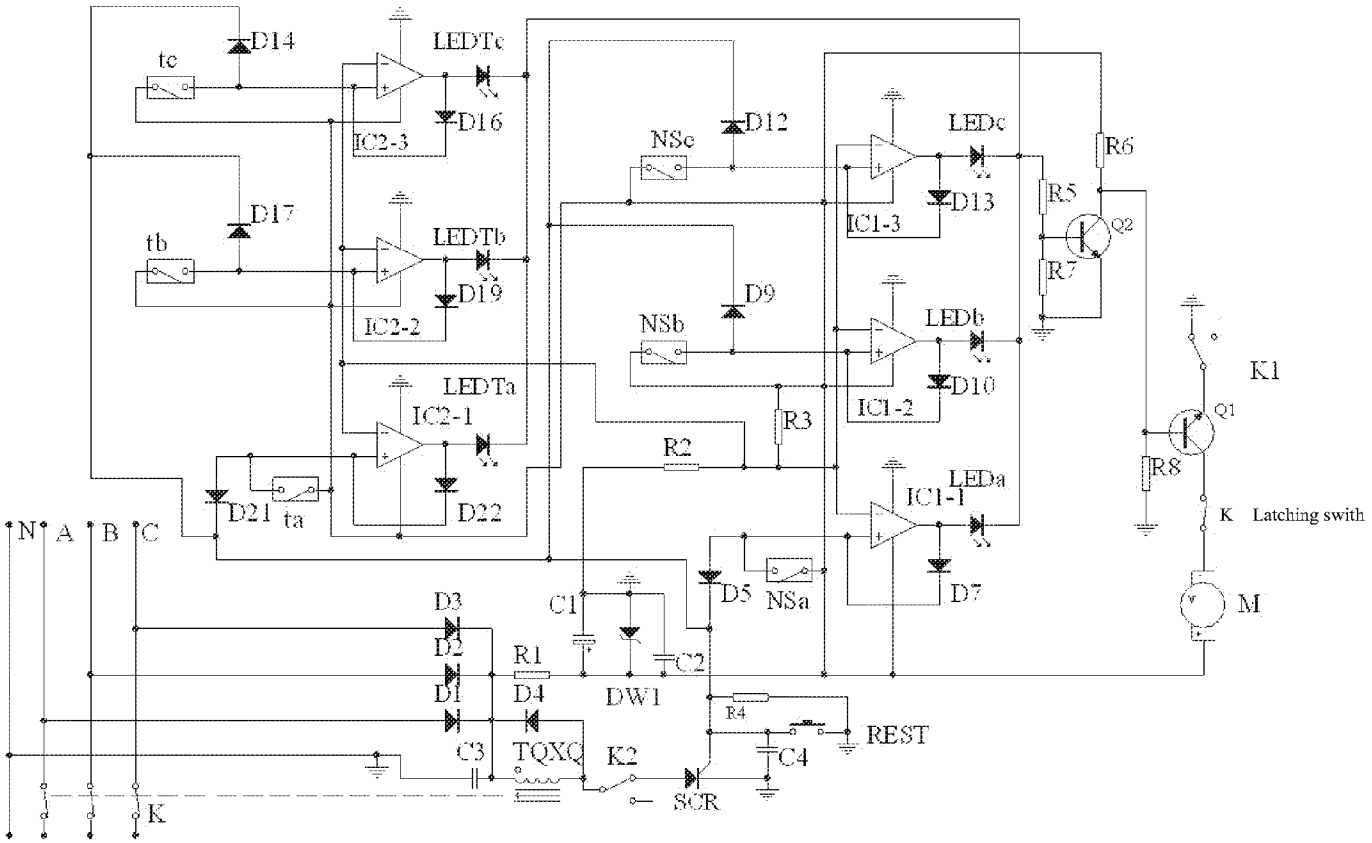
FIG. 13E is a fifth schematic diagram of an automatic closing control subunit of a control part circuit for a built-in circuit breaker of the invention.

As shown in FIG. 13E for a diagram 5 of the automatic closing control subunit of the intelligent circuit breaker with automatic closing function, it's also suitable for a built-in circuit breaker with automatic closing function, and the difference from the diagram 1 mainly lies in that a temperature detection subunit is additionally arranged correspondingly, when the temperature reaches a certain threshold value, the circuit breaker is disconnected, and the self-locking function to the motor is achieved; the temperature detection subunit comprises a temperature detecting element (The temperature sensors ta, tb and tc are taken as an example here) arranged for at least one phase line, wherein the temperature detecting element is connected with a decision element (The comparators IC1-1-IC1-3 are taken as an example here), and the decision element generates at least one of a self-locking control signal and a tripping control signal according to the state of the temperature detecting element at the abnormal temperature. Three groups of temperature sensors ta, tb and tc and comparators IC2-1-IC2-3 (The number of both and the number of phase lines are consistent) are arranged for the embodiment, and one ends of the temperature sensors ta, tb and tc are connected with the noninverting terminals of the comparators IC2-1-IC2-3; the other ends of the temperature sensors ta, tb and tc are connected with the output terminal of the power collection subunit, so as to be used as comparison signals of the comparators IC2-1-IC2-3; the inverting terminals of the comparators IC2-1-IC2-3 obtain a stable voltage signal as the reference voltage; the embodiment is obtained through a group of divider resistors R2 and R3, wherein one end of the divider resistor R2 is connected with the cathode of the capacitor C1 in the voltage regulator circuit, and the other end of the divider resistor R2 is connected with the output terminal of the power collection subunit (share with the short-circuit self-locking subunit); diodes D22, D19 and D16 are arranged between the output terminal and the noninverting terminal of each of the comparators IC2-1-IC2-3; the temperature detection subunit is connected with the control end of the silicon controlled rectifier (SCR), so as to output the tripping control signal to the silicon controlled rectifier (SCR); more preferably, LEDTa-LEDTb are also arranged at the output terminals of the comparators IC2-1-IC2-3 for indication.

Figure 13F:
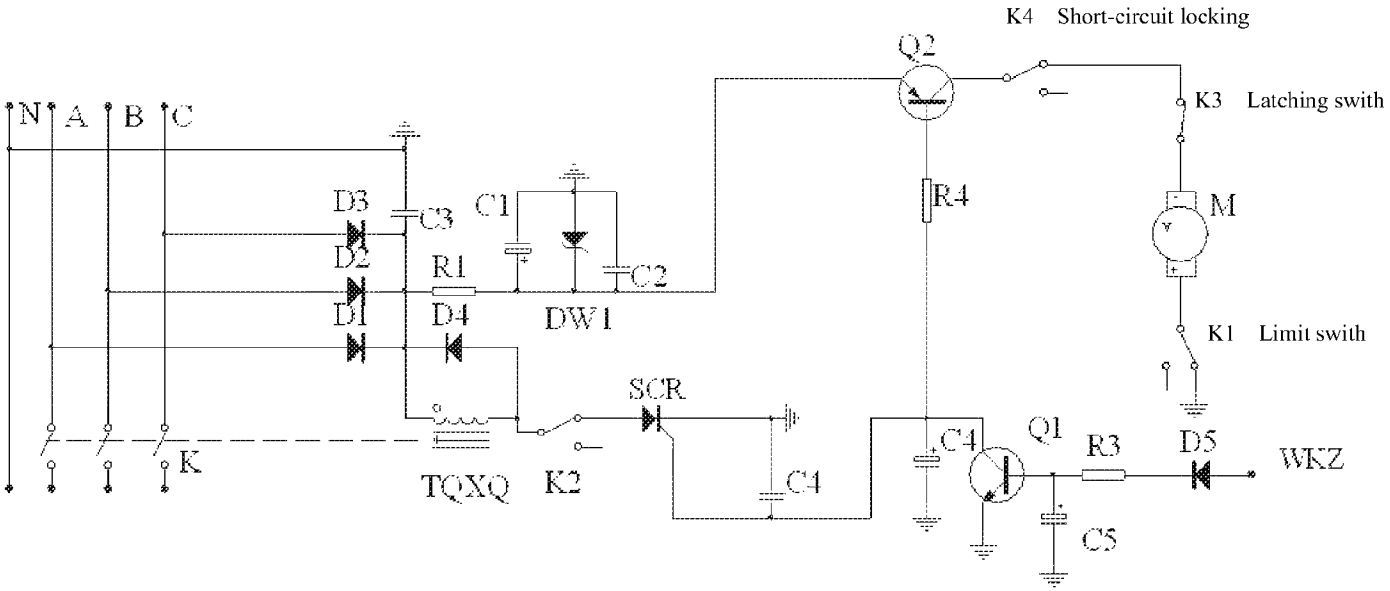
FIG. 13F is a sixth schematic diagram of an automatic closing control subunit of a control part circuit for a built-in circuit breaker of the invention.

As shown in FIG. 13F for a diagram 6 of the automatic closing control subunit of the intelligent circuit breaker with automatic closing function, and it's also suitable for a built-in circuit breaker with automatic closing function; the embodiment is matched with the mechanical short-circuit self-locking method, thus the difference from the diagram 2 on the structure of the circuit mainly lies in that a short-circuit detection unit and a self-locking automatic closing control subunit are not arranged any more, however, the mechanical short-circuit method is only adopted, that is, the purpose of the invention is achieved in the form of short-circuit locking K4 on the circuit.

Figure 13G:
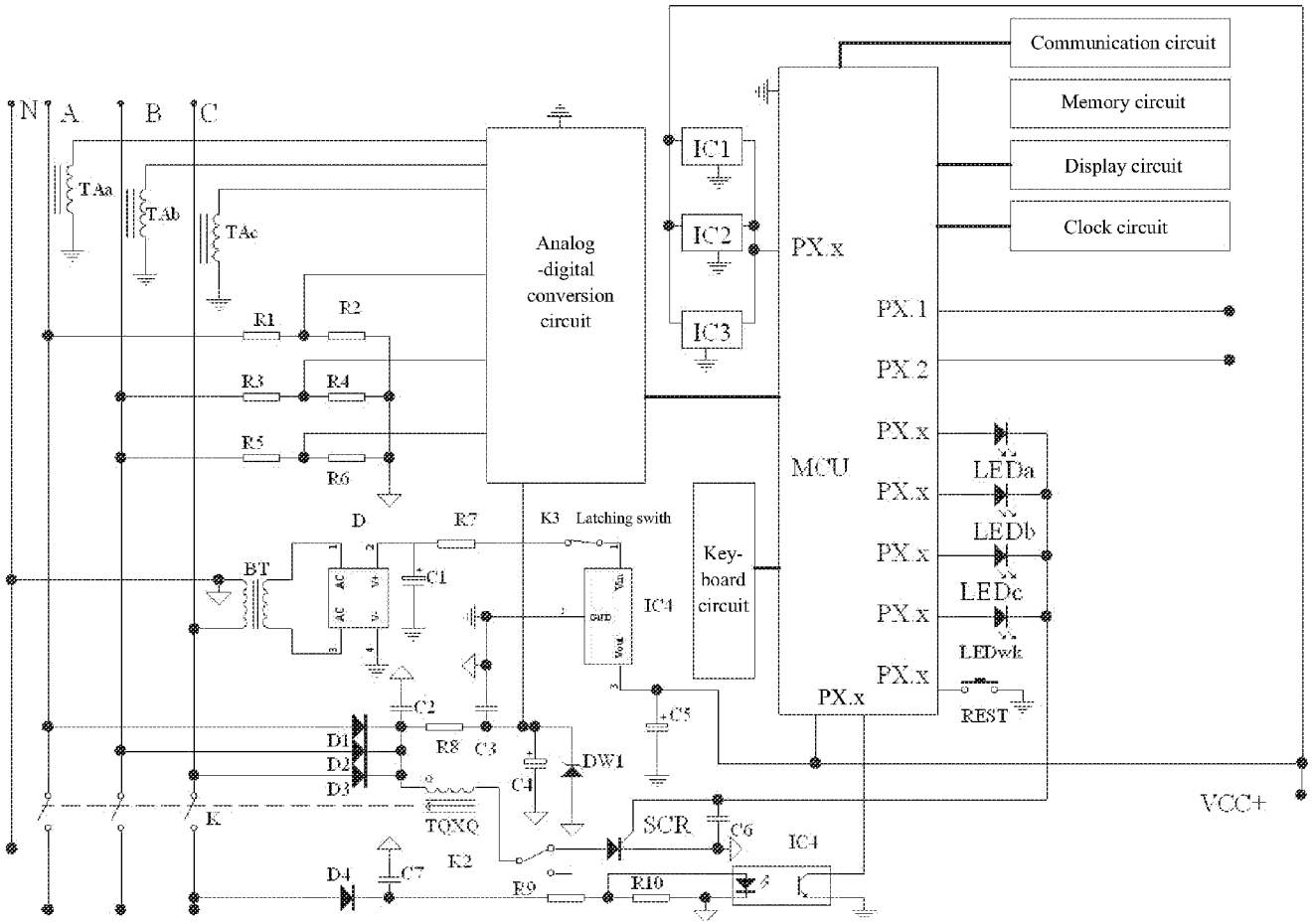
FIG. 13G is a seventh schematic diagram of an automatic closing control subunit of a control part circuit for a built-in circuit breaker of the invention.

As shown in FIG. 13G for a diagram 7 of the automatic closing control subunit of the intelligent circuit breaker with automatic closing function, and it's also suitable for a built-in circuit breaker with automatic closing function; this diagram reflects an example of realizing intelligence through a processor in the prior control technology, wherein, the current value on each phase line is obtained from power lines A, B and C through the current transformers TAa, Tab and TAc, and then is converted into a corresponding digital signal through an analog-digital conversion circuit, the digital signal is transmitted to an MCU, and the program preset in the MCU can be used for determining the obtained electricity information (overcurrent/short-circuit and other abnormal conditions), so as to output the corresponding control signal; an analog power supply circuit comprises divider resistors R1-R6, and the voltage value obtained from each phase line is transmitted to the analog-digital conversion circuit; a digital power supply circuit obtains a power signal from the power line through a voltage transformer BT, and then is connected with the MCU after the processing of a voltage regulator chip D, so as to provide the power signal for the MCU, and a switch K3 is arranged between the digital power supply circuit and the MCU and used for cutting off the electricity supply of the MCU, so as to avoid an accident during the maintenance due to the unreasonable control of the MCU; a group of temperature sensors IC1-IC3 can also be included, which is used for detecting the temperature value at the node of each phase line and converting the temperature value into a digital signal transmitted to the MCU, and the MCU determines whether to output the control signal when the temperature exceeds a threshold value; a rectifier filter circuit comprises three diodes D1-D3, a capacitor C2 and a resistor R8 and supplies power to the tripping device TQXQ, a trip coil of the tripping device is grounded through the silicon controlled rectifier (SCR), and the control end of the controlled rectifier (SCR) is connected with an output terminal of the MCU; to increase the intelligent function, the MCU can also be connected with a communication circuit, can be data-interchanged with other communication devices in a wired or wireless manner, thus the control signals from the outer end can be received; a memory is used for storing various data in the circuit breaker; a display circuit is used for displaying various state information detected by the circuit breaker, and a corresponding display screen is arranged on the box body of the circuit breaker; a clock circuit and a keyboard circuit are respectively used for providing a clock signal and an input command for the MCU; there are various corresponding circuits for the functional circuits above from the specific implementation, each circuit is well-known, and the corresponding circuits can be selected by the technicians in the field as required, thus they are not required to be repeated here; the output terminals PX.1 and PX.2 of the MCU are connected with the self-locking control subunit in the embodiment above for purpose of controlling the action of the automatic closing control subunit of the motor, and can also be directly connected with the automatic closing control subunit of the motor, and the MCU determines whether the automatic closing control subunit is required to work according to whether the present abnormal electricity condition is eliminated.

Figure 13H:
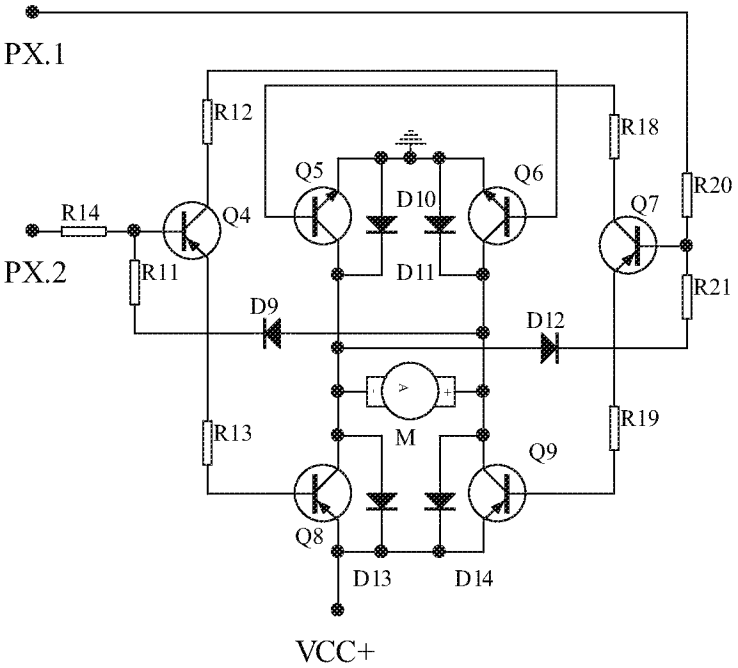
FIG. 13H is a schematic diagram of a control circuit for reciprocating motion of an automatic closing control subunit of an intelligent circuit breaker to a motor.

As shown in FIG. 13H for a diagram of the control circuit for reciprocating motion of the automatic closing control subunit of the intelligent circuit breaker with automatic closing function to the motor, and it's also suitable for a built-in circuit breaker with automatic closing function; in the diagram, there are four groups of PNP triodes Q5, Q6, Q8 and Q9 and protecting diodes D10, D11, D13 and D14, wherein the collecting electrodes are connected with the anodes of the protecting diodes, the emitting electrodes are connected with the cathodes of the protecting diodes, two groups of PNP triodes Q6 and Q9 and collecting electrodes of protecting diodes D11 and D14 are connected at the noninverting terminal of the motor, and the emitting electrodes between the two groups are connected together; the other two groups of PNP triodes Q5 and Q8 and collecting electrodes of protecting diodes D10 and D13 are connected at the inverting terminal of the motor, and the emitting electrodes between the two groups are connected together; in a first unilateral diode D9, the anode is connected with the noninverting terminal of the motor, and the cathode is connected with a control terminal PX.2 of the MCU; in a second unilateral diode D12, the anode is connected with the inverting terminal of the motor, and the cathode is connected with a control terminal PX.1 of the MCU (as shown in FIG. 13G); the base electrode of the PNP triode Q9 is connected with the emitting electrode of the PNP triode Q7, and the base electrode of the PNP triode Q7 is connected with the control terminal PX.1; the base electrode of the PNP triode Q8 is connected with the emitting electrode of the PNP triode Q4, the base electrode of the PNP triode Q4 is connected with the control terminal PX.2, and the collecting electrode of the PNP triode Q4 is connected with the base electrode of the PNP triode Q6; the base electrode of the PNP triode Q5 is connected with the collecting electrode of the PNP triode Q7; meanwhile, the base electrode of the PNP triode Q6 is connected with the collecting electrode of the PNP triode Q4. The positive rotation and the negative rotation of the motor are controlled through the output signals at the control terminals PX.1 and PX.2 of the MCU, so that the reciprocating motion of the corresponding actuating mechanism is realized.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A circuit breaker, comprising:

a circuit breaker body;

a handle;

a bottom box;

a linkage component, the linkage component comprising linkage rod;

a movable contact arm, the movable contact arm comprising a moving contact; and a static contact piece, the static contact piece comprising a stationary contact;

wherein:

the circuit breaker body comprises an upper cover, a notch groove is formed on the upper cover, and two ends of the notch groove are positioned in the on/off position corresponding to the circuit breaker;

the handle extends out of the notch groove;

a circuit breaker actuating mechanism, a wire inlet end, and a wire outlet end are arranged on the bottom box, and the circuit breaker actuating mechanism is triggered by the handle;

the built-in circuit breaker further comprises a bearing plate; the bearing plate is arranged between the upper cover and the bottom box and combined with an electrical operating mechanism, the electrical operating mechanism is provided with an execution end and connected with the handle, and the handle is switched in the on/off state during the operation of the electrical operating mechanism under the control of an automatic closing control unit;

the linkage component is connected to the handle;

the movable contact arm is hinged at the linkage rod; and the static contact piece is connected to the wire outlet end;

when in use, the handle drives the linkage component to rotate;

the linkage component drives the movable contact arm to rotate; and the moving contact arm drives the moving contact to contact with the stationary contact.

2. The circuit breaker of claim 1, wherein the electrical operating mechanism comprises: a pinion-and-rack mechanism and a shifting part; the shifting part is connected with the handle; a motor is arranged in a bottom box, and the pinion-and-rack mechanism transforms the rotation of the motor into reciprocating action of the shifting part, so that the handle is switched in the on/off state.

3. The circuit breaker of claim 1, further comprising a safety switch, wherein:

the safety switch is arranged on the upper cover; and the safety switch corresponds to a corresponding latching switch disposed on the automatic closing control unit.

4. The circuit breaker of claim 1, further comprising a tripping device and a mechanical self-locking mechanism; the mechanical self-locking mechanism comprising:

a limit rod, the limit rod comprising a hooked part;

an axial linkage rod;

a through groove;

a fixing part; and a return spring;

wherein:

the tripping device is arranged on the bottom box;

an action d of the tripping device is connected to the linkage rod;

the hooked part is arranged at one end of the limit rod;

the hooked part is hooked a groove formed on the axial linkage rod;

the axial linkage rod is propped against the linkage component;

the other end of the limit rod is extended out from a hole formed on the upper cover;

the through groove is disposed in a middle of the limit rod;

the fixing part is fixedly connected to the upper cover;

the fixing part penetrates the through groove; and the return spring is arranged in the through groove.

5. The circuit breaker of claim 4, wherein the tripping device is an electromagnet.

* * * * *